US006463234B2

(12) United States Patent
Arimitsu et al.

(10) Patent No.: US 6,463,234 B2
(45) Date of Patent: Oct. 8, 2002

(54) PROCESS CARTRIDGE AND ELECTROPHOTOGRAPHIC IMAGE FORMING APPARATUS

(75) Inventors: Takeshi Arimitsu; Kanji Yokomori, both of Odawara; Susumu Nittani, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/752,675

(22) Filed: Jan. 3, 2001

(65) Prior Publication Data

US 2001/0017994 A1 Aug. 30, 2001

(30) Foreign Application Priority Data

Jan. 5, 2000 (JP) ..... 2000-000441
Dec. 22, 2000 (JP) ..... 2000-390010

(51) Int. Cl.[7] ..... G03G 21/18; G03G 21/16; G03G 15/00

(52) U.S. Cl. ..... 399/113; 399/111; 399/167

(58) Field of Search ..... 399/25, 111, 113, 399/116, 119, 123, 167, 358, 359, 360

(56) References Cited

U.S. PATENT DOCUMENTS 4,327,992 A * 5/1982 Babicz ..... 399/167
5,331,378 A * 7/1994 Baker et al. ..... 399/111
5,502,547 A * 3/1996 Shirai ..... 399/102
5,537,187 A * 7/1996 Sekine ..... 399/113
5,631,726 A * 5/1997 Sawada ..... 399/111
5,903,803 A * 5/1999 Kawai et al. ..... 399/116
5,937,241 A * 8/1999 Kumar et al. ..... 399/111
5,946,531 A 8/1999 Miura et al. ..... 399/111
5,983,056 A * 11/1999 Fukami et al. ..... 399/167
6,002,896 A 12/1999 Miyamoto et al. ..... 399/114
6,055,406 A 4/2000 Kawai et al. ..... 399/360
6,061,538 A 5/2000 Arimitsu et al. ..... 399/111

* cited by examiner

*Primary Examiner*—Sandra Brase
(74) *Attorney, Agent, or Firm*—Fitzpatrick, Cella, Harper & Scinto

(57) ABSTRACT

A process cartridge detachably mountable to a main assembly of an electrophotographic image forming apparatus includes a first frame; a second frame rotatablely coupled with the first frame; an electrophotographic photosensitive drum provided in the first frame; a developing member, provided in the second frame, for developing a latent image formed on the photosensitive drum with a developer; a cleaning member, provided in the first frame, for removing the developer remaining on the drum; a removed developer feeding member, provided in the first frame, for transporting the developer removed by the cleaning member; a drum driving force receiving member, provided in the first frame, for receiving, from the main assembly, a driving force for rotating the drum when the process cartridge is mounted to the main assembly; a development driving force receiving member, provided in the second frame, for receiving, from the main assembly, a driving force for rotating the developing member when the process cartridge is mounted to the main assembly of the apparatus; a driving force transmitting member, provided in the second frame, for transmitting, to the removed developer feeding member, the driving force received from the main assembly by the development driving force to rotate the removed developer feeding member.

20 Claims, 16 Drawing Sheets

PROCESS CARTRIDGE AND ELECTROPHOTOGRAPHIC IMAGE FORMING APPARATUS

FIELD OF THE INVENTION AND RELATED ART

The present invention relates to a process cartridge, and an electrophotographlc image forming apparatus in which a process cartridge is removably installable, and which form an image on recording medium.

Here, an electrophotographic image forming apparatus is an apparatus that forms an image on a recording medium with the use of an electrophotographic image forming method. As an example of an electrophotographic image forming apparatus, an electrophotographic copying machine, an electrophotographic printer (for example, laser beam printer, LED printer, and the like), a facsimile apparatus, a word processor, and the like can be included.

A process cartridge is cartridge that is removably installable in the main assembly of an image forming apparatus, and in which a single or plural processing means and an electrophotographic photosensitive drum, are integrally placed. More specifically, a process cartridge is: a process cartridge that removably installable in the main assembly of an image forming apparatus, and in which a charging means, either a developing means or a cleaning means, and an electrophotographic photosensitive member, are integrally placed; a cartridge that is removably installable in the main assembly of an image forming apparatus, and in which at least one of the processing means among a charging means, a developing means, and a cleaning means, and an electrophotographic photosensitive drum, are integrally placed; or a cartridge that is removably installable in the main assembly of an image forming apparatus, and in which at least a developing means among the aforementioned processing means, and an electrophotographic photosensitive member, are integrally placed.

Conventionally, an electrophotographic image forming apparatus that employs an electrophotographic-image-forming process employs a process-cartridge system, according to which an electrophotographic photosensitive member, and a single or a plurality of the aforementioned processing means, which act upon an electrophotographic photosensitive member, are integrally placed in a cartridge removably installable in the main assembly of an image forming apparatus. According to this process-cartridge system, an image forming apparatus can be maintained by the users themselves, without relying on service personnel, remarkably improving operational efficiency. Thus, a process-cartridge system is widely used in the field of an image forming apparatus.

Referring to FIGS. 16 and 17, the conventional technologies regarding the aforementioned process cartridge will be described.

A conventional process cartridge 200 comprises a cleaning unit 201, a development unit 202, and a developer containing unit 203. The cleaning unit 201 holds a photosensitive drum 204, a charge roller 205, a cleaning blade 206, a removed developer conveying member 207, and the like. The development unit 203 and developer containing unit 203 are fixed to each other, and jointly hold a development roller 209, a development blade 210, a developer conveying member 211, a stirring member 212, and the like.

The photosensitive drum 204 is rotated by the driving force transmitted thereto from a drum driving force inputting portion, which is provided on the main assembly side of an image forming apparatus, to a driving gear 213 positioned in such a manner that the axial line of the driving gear 213 aligns with the axial line of the photosensitive drum 4. On the other hand, the development roller 209 rotates as it receives the driving force from a driving gear 213, which receives the driving force from a driving gear 214. Further, a driving force is transmitted to the stirring member 212 in the developer containing unit 203, by the developer stirring member driving gear 216 that receives a driving force from the driving gear 214 by way of idler gears 215*a* and 215*b*. The developer conveying member 211 in the development unit 202 rotates as the driving force is transmitted thereto by a developer conveying member driving gear 218 to which driving force is transmitted from the developer stirring member driving gear 216 by way of an idler gear 217. The removed developer conveying member 207 rotates in the counterclockwise direction as the driving force is put into a removed developer conveying member driving gear 220 by way of an idler gear 219.

There has been a tendency to increase the developer capacity of a process cartridge in order to increases the cartridge-exchange interval, that is, the service life, of a conventional process cartridge such as the one described. As a result, the amount of the removed toner has increased, making it necessary to increase the capacity of the removed developer storing portion of a process cartridge.

With the increase in the amount of the removed developer, the load applied to the removed developer conveying member is bound to increase. On the other hand, in order to reduce the overall size of an image forming apparatus, the process cartridge size must be reduced.

SUMMARY OF THE INVENTION

The primary object of the present invention is to provide a process cartridge capable of efficiently storing the removed developer in its removed developer storage portion, and an electrophotographic image forming apparatus in which such a process cartridge is removably installable.

Another object of the present invention is to provide a compact process cartridge, the size of which is realized by efficiently storing the removed developer in its removed developer storage portion, in spite of the increase in the amount of the removed developer, resulting from an increase in the service life of a process cartridge, and an electrophotographic image forming apparatus in which such a process cartridge is removably installable.

Another object of the present invention is to provide a process cartridge in which the increase in the amount of the load placed upon a removed developer conveying member for conveying the removed developer, does not affect the rotation of the photosensitive drum, and an electrophotographic image forming apparatus in which such a process cartridge is removably installable.

Another object of the present invention is to provide a process cartridge which is removably installable in the main assembly of an electrophotographic image forming apparatus, and which comprises: a first frame portion; a second frame portion pivotally attached to the first frame portion; an electrophotographic photosensitive drum, which is placed in the first frame portion; a developing member, which is placed in the second frame portion to develop an electrostatic latent image formed on the photosensitive drum, with the use of developer; a cleaning member, which is placed in the first frame portion to remove the developer remaining on the photosensitive drum; a removed developer conveying member, which is placed in the first frame portion to convey the developer removed by the cleaning member; a drum driving force transmitting member, which is placed in the first frame portion to receive the force for rotationally driving the photosensitive drum, from the main assembly of an image forming apparatus, when the process cartridge is in the apparatus main assembly; a developing member driving force transmitting member, which is placed in the second frame portion to receive the force for rotationally driving the developing member, from the apparatus main assembly, when the process cartridge is in the apparatus main assembly; and a driving force transmitting member, which is placed in the second frame portion to transmit to the removed developer conveying member, the force received by the developing member driving force transmitting member from the apparatus main assembly, in order to rotate the removed developer conveying member, and also to provide an electrophotographic image forming apparatus in which such a process cartridge is removably installable.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Embodiment 1

Figure 1:
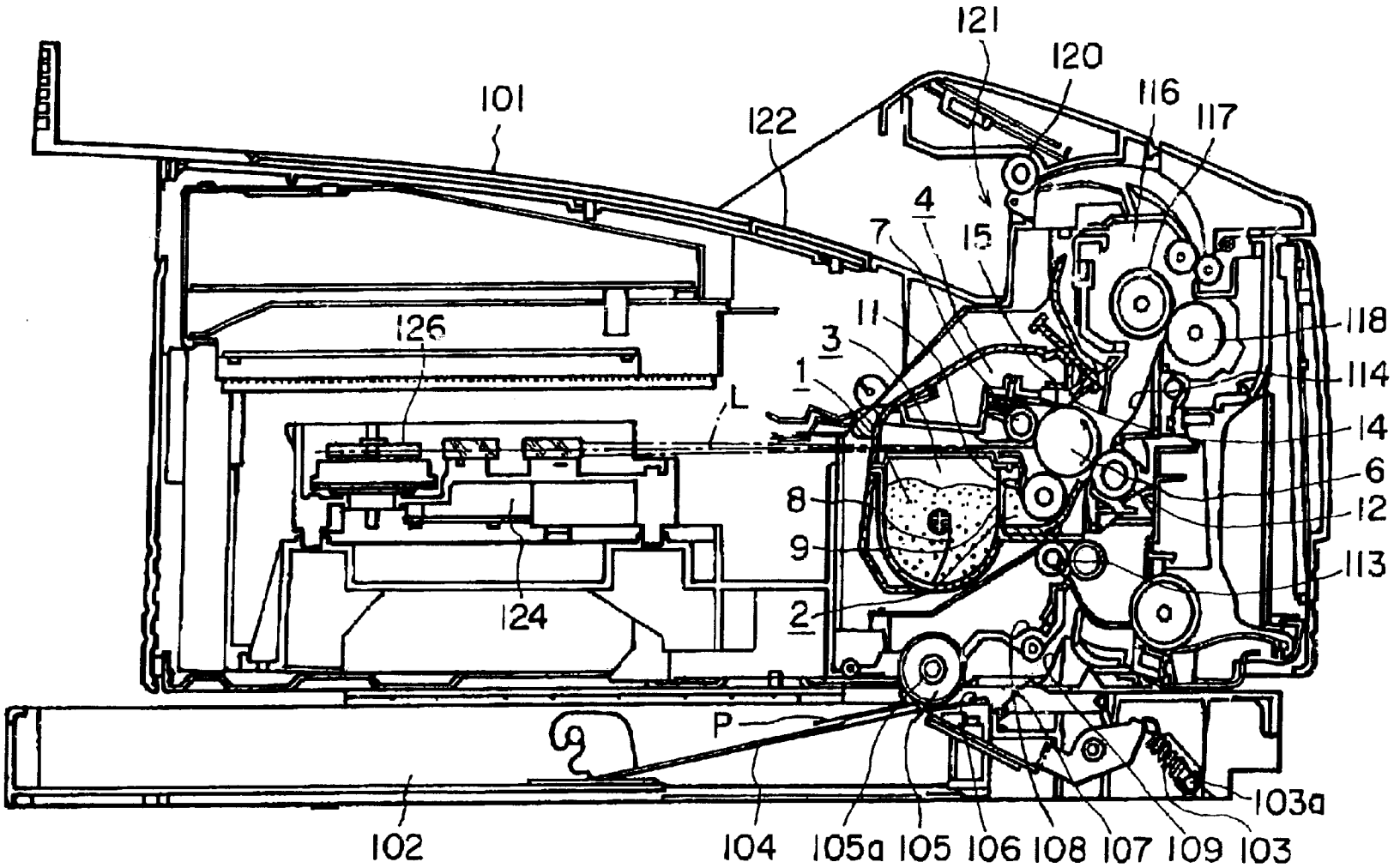
FIG. 1 is a drawing for showing the general structure of the electrophotographic image forming apparatus in the first embodiment.
Figure 2:
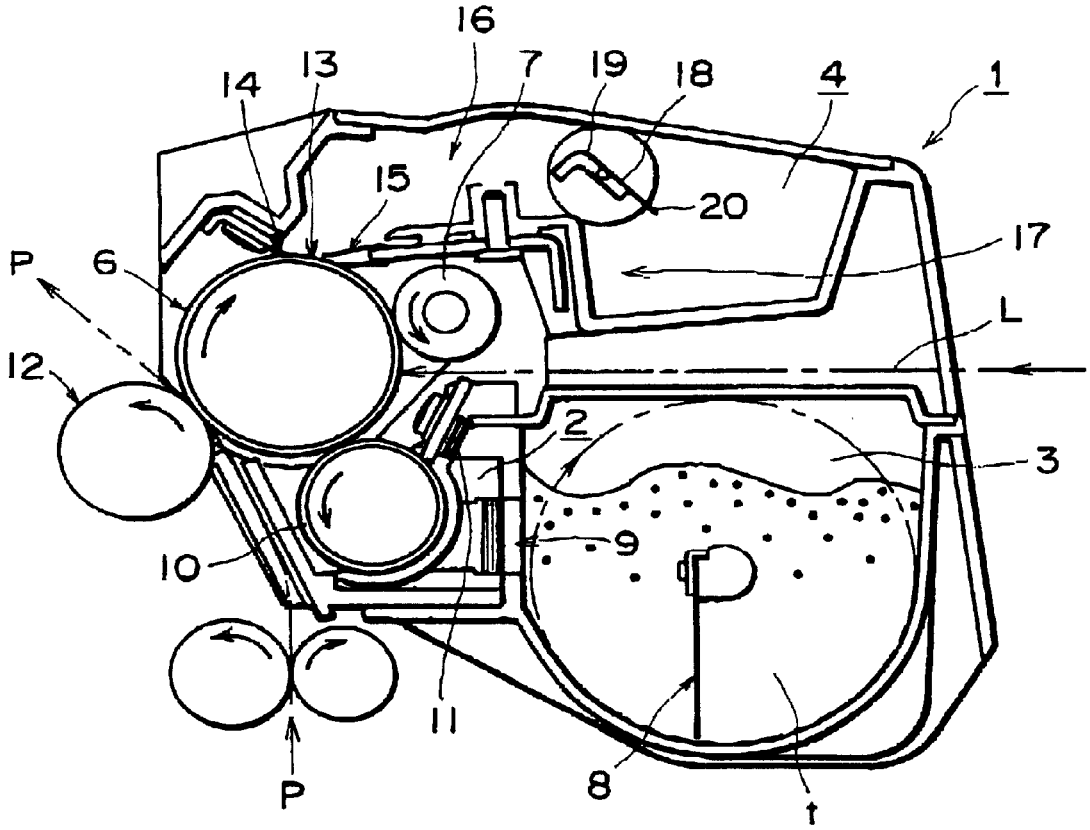
FIG. 2 is a drawing for showing the general structure of the process cartridge in the first embodiment of the present invention.
Figure 3:
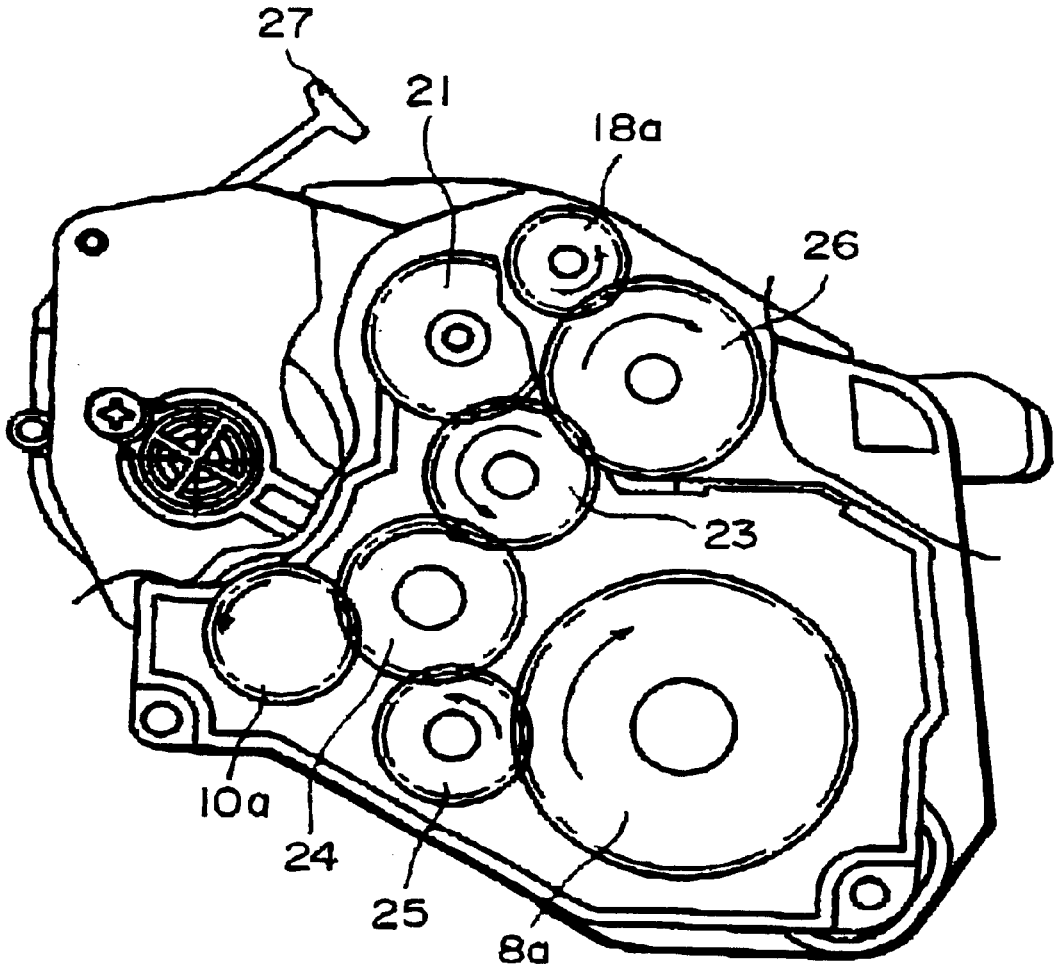
FIG. 3 is a drawing for showing the driving force transmission mechanism in the process cartridge.
Figure 4:
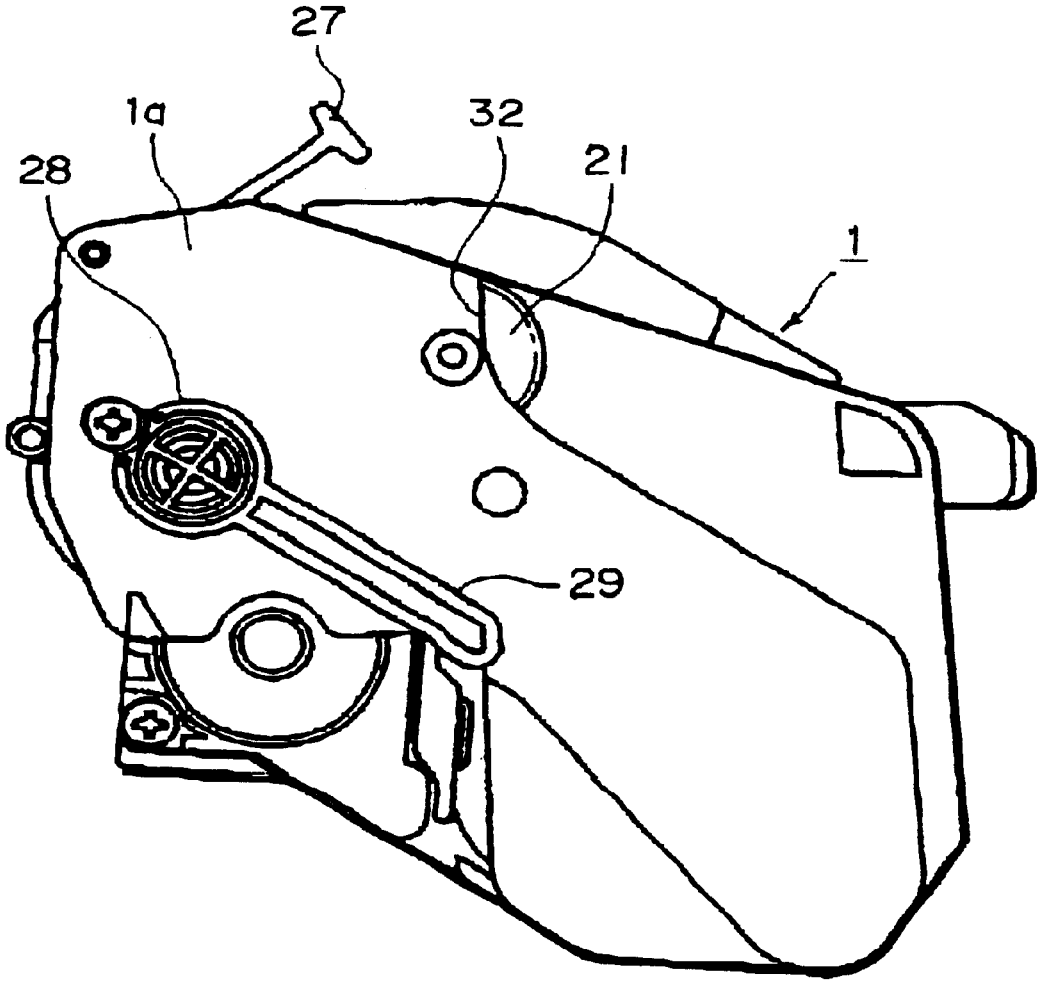
FIG. 4 is an external view of the process cartridge.
Figure 5:
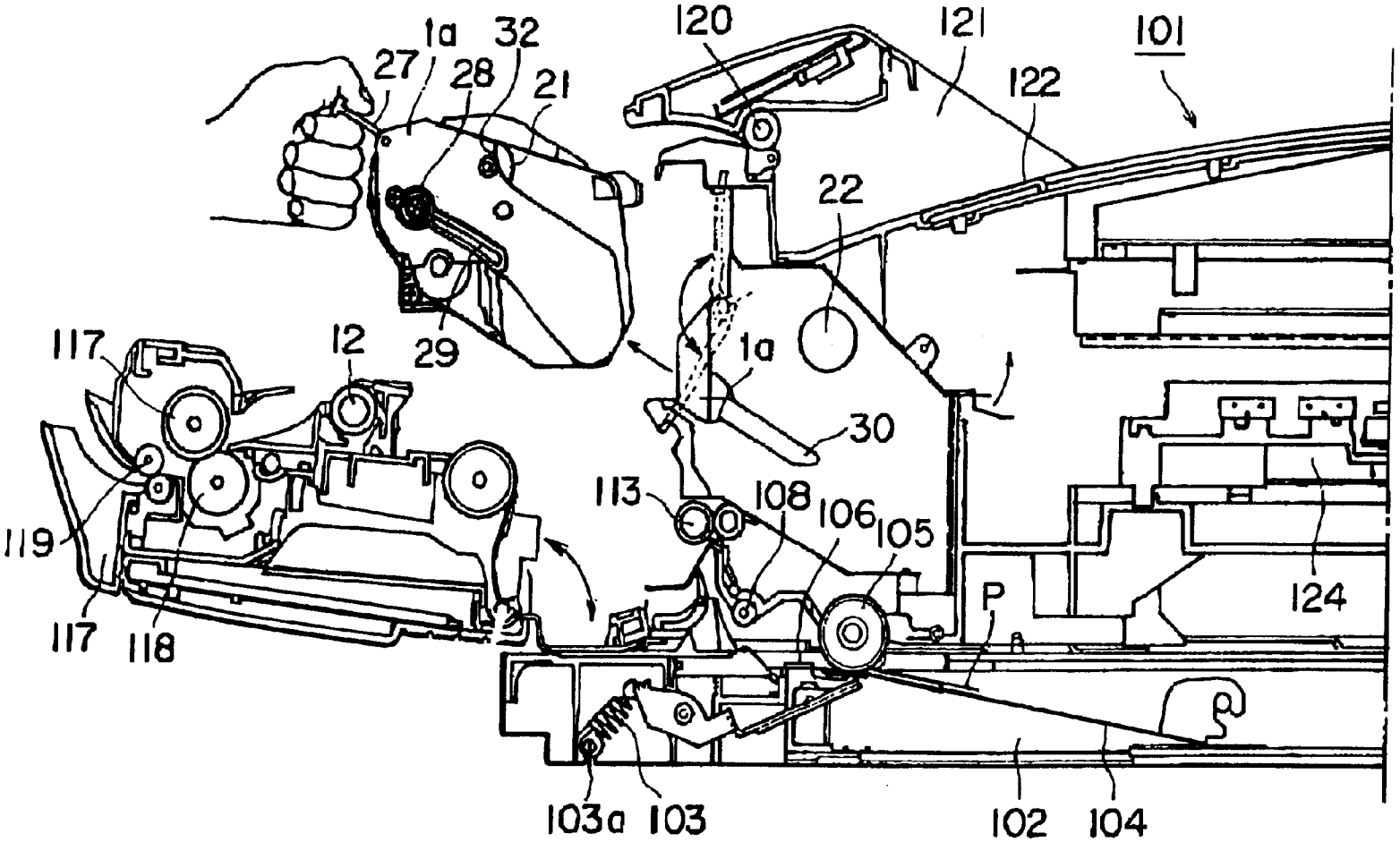
FIG. 5 is a drawing for showing the procedure for installing the process cartridge into the apparatus main assembly.

First, the process cartridge and electrophotographic image forming apparatus in this embodiment will be described with reference to the appended drawings. FIG. 1 is a drawing for showing the general structure of the electrophotographic image forming apparatus in this embodiment, and FIG. 2 is a drawing for showing the structure of the process cartridge in this embodiment. FIG. 3 is a drawing for showing the driving force transmitting mechanism in this embodiment, and FIG. 4 is an external view of the process cartridge. FIG. 5 is a drawing for showing the procedure for installing the process cartridge into the main assembly of the image forming apparatus.

In the following description of the present invention, the "widthwise direction" of the process cartridge is the direction in which the process cartridge is installed into, or removed from, the apparatus main assembly, whereas the "longitudinal direction" of the process cartridge means is the direction perpendicular (roughly perpendicular) to the direction in which the process cartridge is installed into, or removed from, the apparatus main assembly. The "top surface" of the process cartridge is the surface of the process cartridge that faces upward when the process cartridge is in the apparatus main assembly, whereas the "bottom surface" of the process cartridge is the surface of the process cartridge that faces downward when the process cartridge is in the apparatus main assembly.

(Electrophotographic Image Forming Apparatus)

The image forming apparatus 101 illustrated in. FIG. 1 is a laser beam printer which employs an electrophotographic image forming method. First, the structure of the conveying means for conveying a sheet of recording medium P (recording paper, OHP sheet, and the like) will be described. Plural sheets of recording medium P are placed in layers in a cassette 102. The leading edge portion of the top sheet of the layers of recording media P is kept in contact with the peripheral surface of a sheet feeding roller 105 by a sheet feeding plate 104 which is under the pressure generated by a pair of sheet feeding springs 103. The cassette 102 can be pulled out of the apparatus main assembly in the rightward direction in FIG. 1, so that the users can place plural sheets of recording medium P in the cassette 102. As the cassette 102 is pulled out from the apparatus main assembly, a pair of shafts 103*a* slide upward, being guided by a pair of grooves (unillustrated) in the side walls of the cassette 102*a*. As a result, the sheet feeding plate 104 descends to the bottom of the cassette 102 to allow recording medium P to be smoothly loaded into the cassette 102.

A feeding roller 105 is fixed to a shaft 105*a*. The shaft 105*a* is provided with a clutch and a solenoid switch (unillustrated), which are attached to one of the longitudinal ends of the shaft 105*a*, in order to control the rotational driving of the feeding roller 105. On the leading edge side of the recording medium P with respect to the feeding roller 105, in terms of the direction in which the recording medium P is conveyed, a separating claw 106 is located. Further, on the leading edge side of the recording medium P with respect to the separating claw 106, a cassette entrance guide 107 is positioned close to the separating claw 106, being enabled to be pivotally moved by the pressure from a spring (unillustrated). Further, the base portion 108 of the apparatus main assembly is provided with a pair of guide portions 109, extending in parallel to the lateral walls of the cassette 102 to guide the recording medium P to a registration roller 113.

As a solenoid switch (unillustrated) is turned on by a sheet feeding start signal, a driving force is transmitted to the shaft 105*a* through the clutch. As a result, the feeding roller 105 is rotated to guide the recording medium P to the cassette entrance guide 107. Then, only the top recording medium P is sent out of the cassette 102 because of the coefficient of friction. Then, the rotation of the feeding roller 105 causes the leading edge of the recording medium P to reach the nip portion of the registration roller 113, from which the recording medium P is released forward to be conveyed to the interface between a photosensitive drum 6 and a transfer roller 12 by the registration roller 113, in synchronism with the leading edge of a developer image on the photosensitive drum 6, which will be described later.

Thereafter, the developer image, which has been formed on the photosensitive drum 6 through an image formation process, which will be described later, is transferred onto the recording medium P by a transfer roller 12 that is kept pressed upon the photosensitive drum 6 by a predetermined amount of pressure.

After the transfer of the developer image onto the recording medium P, the recording medium P is guided into a fixing means 116 by a fixing-means-entrance guide 114. As the recording medium P passes through the nip between a fixing roller 117 and a pressure roller 118, the developer image is fixed to the surface of the recording medium P. Then, the recording medium P is discharged from the apparatus main assembly by a discharge roller 120, and accumulated in a delivery tray 122 provided next to a sheet delivery opening 121.

Next, the structure of a scanner unit 124, which is a laser based optical system of the image forming station, will be described. A beam L of laser light is moved by the rotational driving of a polygon mirror 126, in a manner to scan the peripheral surface of the photosensitive drum 6 in a direction parallel to the generating line of the photosensitive drum 6. During this scanning movement of the laser beam L, the laser of the scanning unit 124 is turned on and off to change the potential level of the illuminated points on the photosensitive drum 6 to a predetermined level. As a result, an electrostatic latent image is formed on the photosensitive drum 6.

(Process Cartridge)

Next, referring to FIG. 2, the structure of a cartridge 1 will be described. The cartridge 1 in this embodiment comprises: the photosensitive drum 6; a charge roller for charging the photosensitive drum 6 for image formation (primary charge); a development station 2 for developing an electrostatic latent image formed on the photosensitive drum 6; a developer container 3 for holding developer; a cleaning station 4 for recovering the developer remaining on the peripheral surface of the photosensitive drum 6 after image transfer; a removed developer storing portion for storing the removed and recovered developer; and the like. The development station 2 and developer container 3 are constructed as two integral parts of a development unit.

The image forming method employed by the image forming apparatus in this embodiment is one of the commonly known electrophotographic processes. The structure of the cartridge 1 in this embodiment will be described with reference to this electrophotographic process. The charge roller 7 is positioned adjacent to the peripheral surface of the photosensitive drum 6, on the upstream side of the exposing point, that is, the point at which the peripheral surface of the photosensitive drum 6 is exposed to the laser beam L. The charge roller 7 is a semiconductive elastic member, which is kept pressed upon the photosensitive drum 6 by a predetermined amount of pressure, and follows the rotation of the. photosensitive drum 6. As bias is applied to the charge roller 7, the peripheral surface of the photosensitive drum 6 is uniformly charged. Then, as described above. the peripheral surface of the photosensitive drum 6 is scanned by the laser beam L, and as a result, an electrophotographic latent image is formed on the peripheral surface of the photosensitive drum 6.

Meanwhile, a certain amount of the developer t in the developer container, which is the same in polarity as the primary charge, is picked up by a stirring member 8, and is sent into the development station 2, through a developer supplying opening 9, by the stirring member 8. Then, the developer t is adhered to the peripheral surface of a development roller 10, and is formed into a thin layer of the developer t by a development blade 11 while being triboelectrically charged by the development blade 11 In addition, bias is applied to the development roller 10. As a result, the developer t is adhered to the. peripheral surface of the photosensitive drum 6, in a pattern which reflects the electrostatic latent image on the peripheral surface of the photosensitive drum 6. Consequently, the latent image is developed into a developer image, or a visible image. Then, the developer image, or an image realized as a visible image, on the photosensitive drum 6. is transferred onto the recording medium P by the transfer roller 12 as described above.

On the other hand, a small amount of developer remains adhered to the peripheral surface of the photosensitive drum 6 even after the image transfer. The cleaning station 4 is provided with an opening 13 which faces the Photosensitive drum 6. On the upstream side of the opening 13, a squeezer sheet 14 is positioned in contact with the photosensitive drum 6, being tilted in a manner to conform to the moving direction of the peripheral surface of the photosensitive drum 6. On the downstream side of the opening 13, a cleaning blade 15 as a cleaning member is disposed in contact with the peripheral surface of the photosensitive drum 6, being tilted in a manner to contradict the moving direction of the peripheral surface of the photosensitive drum 6. With the provision of the above arrangement, the developer t on the photosensitive drum 6 first slips through the interface between the squeezer sheet 14 and photosensitive drum 6, is scrapped away from the peripheral surface of the photosensitive drum 6 by the cleaning blade 15, and then, is collected in the cleaning means containing portion 16. Thus, the portion of the peripheral surface of the photosensitive drum 6, which has just passed the cleaning blade 15, has no developer t, and is used for the image formation process during the following rotation of the photosensitive drum 6.

There is also a removed developer storing portion 17 in the cleaning means containing portion 16. The removed developer storing portion 17 is positioned at approximately the same level, above the developer container 3. The recovered developer is stored in this removed developer storing portion 17 as it is recovered. Also in the cleaning means containing portion 16, a conveying member 18 for conveying the removed developer, that is, the developer scraped away from the photosensitive drum 6 by the cleaning blade 15, to the removed developer storing portion 17, is located. The conveying member 18 extends across practically the entirety of the cleaning means containing portion 16, in terms of the longitudinal direction. It comprises a metallic plate 19, which serves as the sheet mount as well as a counter balance, and a sheet 20 of polyethylene-terephthalate (PET), or the like, attached to the metallic plate 19. With the provision of the above described arrangement. after being recovered onto the cleaning blade 15, the removed developer t is stored into the removed developer storing portion 17.

Next, referring to FIGS. 2 and 3, the method for driving the cartridge 1 will be described. The development roller 10 is provided with a gear 10*a*, which is attached to one of the longitudinal end of the development roller 10, and the rotational axis of which coincides with that of the development roller 10. The stirring member 8 is provided with a gear 8*a*, which is fixed to the stirring member 8, on the same side as the gear 10*a*, and rotates with the stirring member 8. Further, the conveying member 18 is provided with a gear 18*a*, which is fixed to the conveying member 18 in the same manner as the gears 10*a* and 8*a*.

The development unit which comprises the development station 2 and developer container 3 is provided with a gear 21, which is rotatably attached to the side wall of the development unit. To this gear 21, a driving force is transmitted from a gear 22 (FIG. 5) provided on the apparatus main assembly side. The driving force inputted into the gear 21 is transmitted to the aforementioned gear 10*a* by way of idler gears 23 and 24. The idler gear 24 transmits a driving force to the aforementioned gear 8*a* through an idler gear 25. Further, to the gear 18*a*, the driving force inputted into the aforementioned gear 21 is transmitted by way of the idler gear 23 and an idler gear 26.

With the provision of the above described structural arrangement, the gear 10*a* for transmitting the driving force to the development roller 10 and the gear 18*a* for transmitting the driving force to the aforementioned conveying member 18 can be positioned adjacent to each other, enabling the gear 18*a* to receive the driving force from the driving system comprising the gear 21, gear the 10*a*, and the gears between them. Therefore, the number of gear trains can be reduced to reduce the space necessary for the gear trains.

Next, referring to FIGS. 4 and 5, the installation of the cartridge 1 into the apparatus main assembly 101, and the removal of the cartridge 1 from the apparatus main assembly, will be described, and the positioning of the cartridge 1 relative to the apparatus main assembly 101 will be described. The cartridge 1 is installed into, or removed from, the apparatus main assembly 101, using a handle 27 of the shell portion of the cartridge 1. A user installs the cartridge 1 into the cartridge space in the apparatus main assembly, by holding this handle 27. With the provision of the following positioning mechanism, and guiding mechanism, the cartridge 1 can be accurately installed into, and positioned relative to, the apparatus main assembly 101.

The external frame 1*a* of the cartridge 1 is provided with a flanges 28 for positioning the cartridge 1, and a pair of ribs 29 which prevent the skewing of the cartridge 1, and serve as guides, during the installation of the cartridge 1 into the apparatus main assembly 101. On the other hand, the base 108 of the apparatus main assembly 102 is provided with a pair of guiding slots 30 which guide the aforementioned ribs 29 while controlling the skewing of the cartridge 1, and a positioning portion 31 for position the cartridge 1 relative to the apparatus main assembly.

Further, the external frame portion 10*a* is provided with a slot 32, through which the tooth flank of the gear 21 is partially exposed. During the insertion of the cartridge 1 into the apparatus main assembly 101, as the flange 28 comes into contact with the positioning portion 31, the exposed portion of the tooth flank of the gear 21 meshes with the gear 22, making it possible for the driving force to be transmitted.

One of the longitudinal ends of the photosensitive drum 6 is provided with a coupling means (unillustrated), the axial line of which coincides with that of the photosensitive drum 6, and which is integral with the photosensitive drum 6, whereas the apparatus main assembly 101 is provided with a driving force inputting means (unillustrated), which is different from the gear 22. Also during the insertion of the cartridge 1 into the apparatus main assembly 101, as the flange 28 comes into contact with the positioning portion 31, that is, as the flange 28 reaches a predetermined position, the driving force inputting means transmits the driving force to the coupling means integral with the photosensitive drum. Incidentally, the coupling means may be either a gear-type coupling or a jaw-type coupling.

Since the means for driving the photosensitive drum 6, the means for driving the development roller 10, and the mechanism for driving the development roller 10, the stirring member 8, and the conveying member 18, are independently provided, it does not occur that the fluctuation in the rotation of the stirring member 8 and/or conveying member 18, and the vibrations of the stirring member 8 and/or conveying means 18, are directly transmitted to the means for driving the photosensitive drum 6. Therefore, even if the accumulation of the removed developer increases the amount of the load which applies to the conveying member 18, the rotation of the photosensitive drum 6 is not likely to be affected.

Embodiment 2

Figure 6:
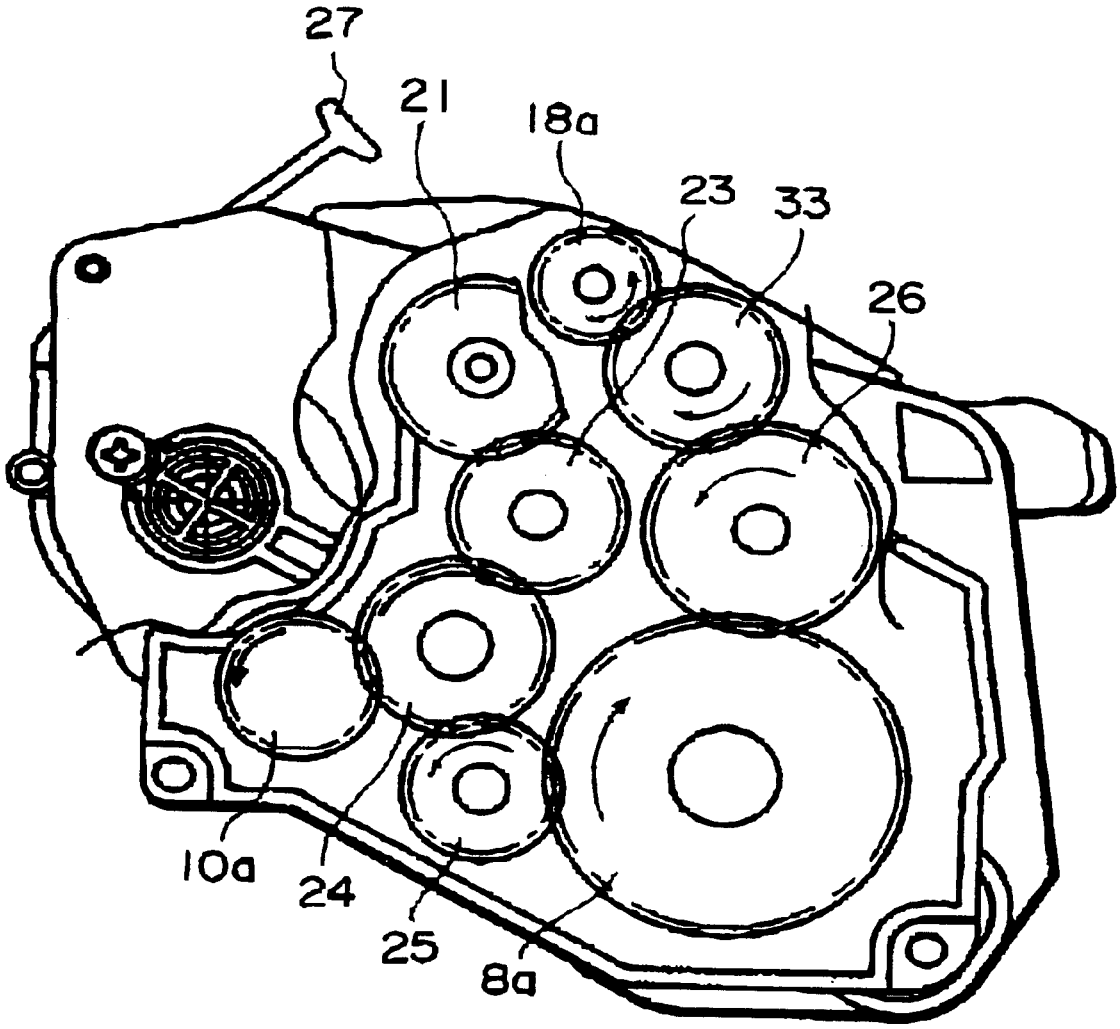
FIG. 6 is a drawing for showing the process cartridge in the second embodiment of the present invention.

Referring to FIG. 6, the process cartridge in this embodiment of the present invention will be described. The portions of the process cartridge in this embodiment, the descriptions of which will be the same as those of the process cartridge in the first embodiment, will be given the same referential codes and their actual descriptions will be omitted here. Also in this embodiment, a conveying member 18 for conveying the removed developer from the top surface of a cleaning blade 15 to a removed developer storing portion 17, is provided in the cleaning means containing portion 16 as in the first embodiment.

The transmission of the driving force to the gear 10*a* of a development roller 10, and the gear 8*a* of a stirring member 8, is the same as that in the first embodiment, except for a minor difference. That is, in the first embodiment, the driving force is transmitted from the gear 21 to the gear 18*a* by way of idler gears 23 and 26, whereas in this embodiment, the driving force is transmitted to gear 18*a* from the gear 8*a* by way of gears 26 and 33.

The provision of the above described structural arrangement makes it possible for the gear 18*a* to receive the driving force from the driving mechanism comprising the gears from gear 21 to gear 10*a*. Therefore, the same effects as those in the first embodiment can be obtained.

Embodiment 3

Figure 7:
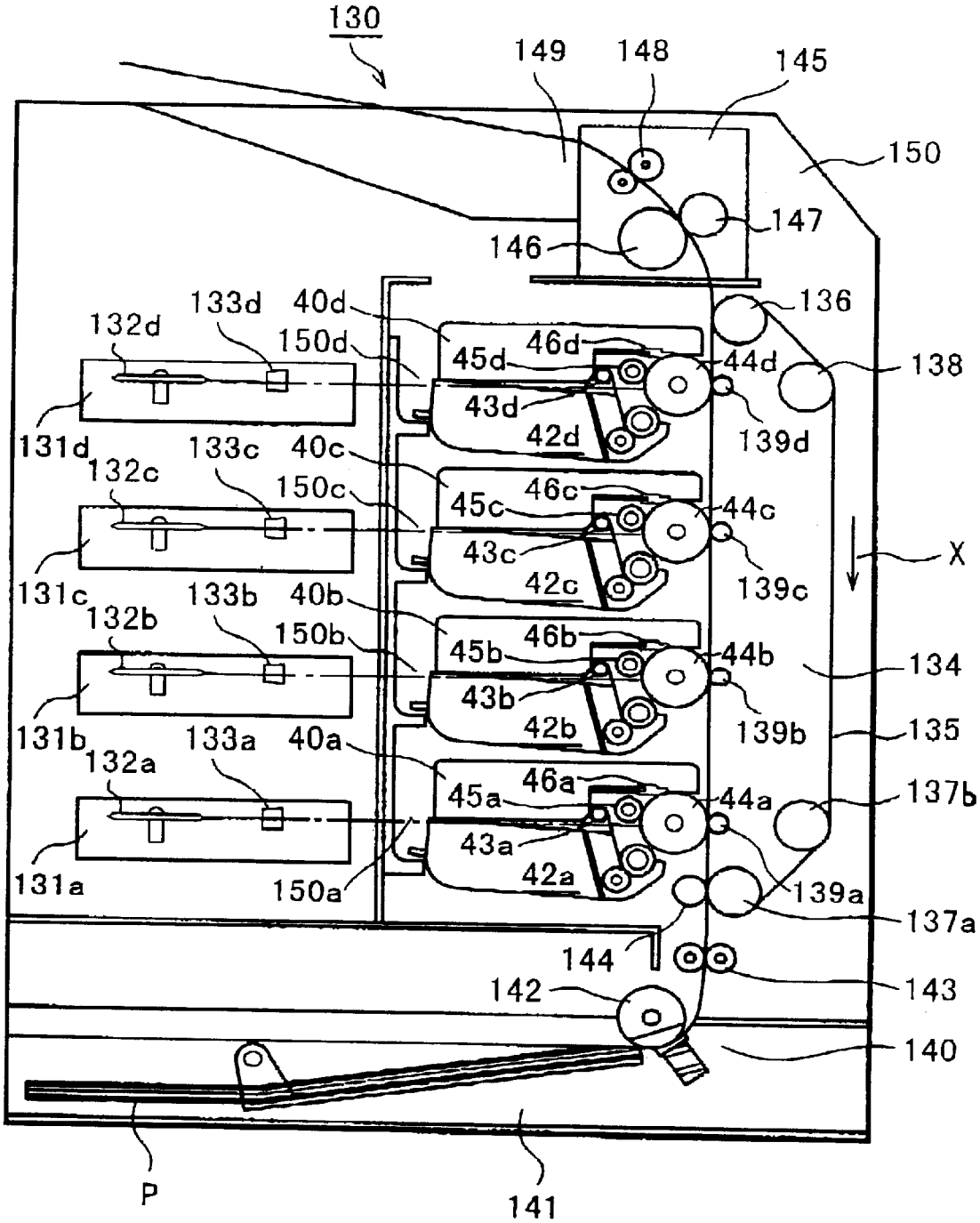
FIG. 7 is a drawing for showing the general structure of the electrophotographic image forming apparatus in the third embodiment of the present invention.
Figure 8:
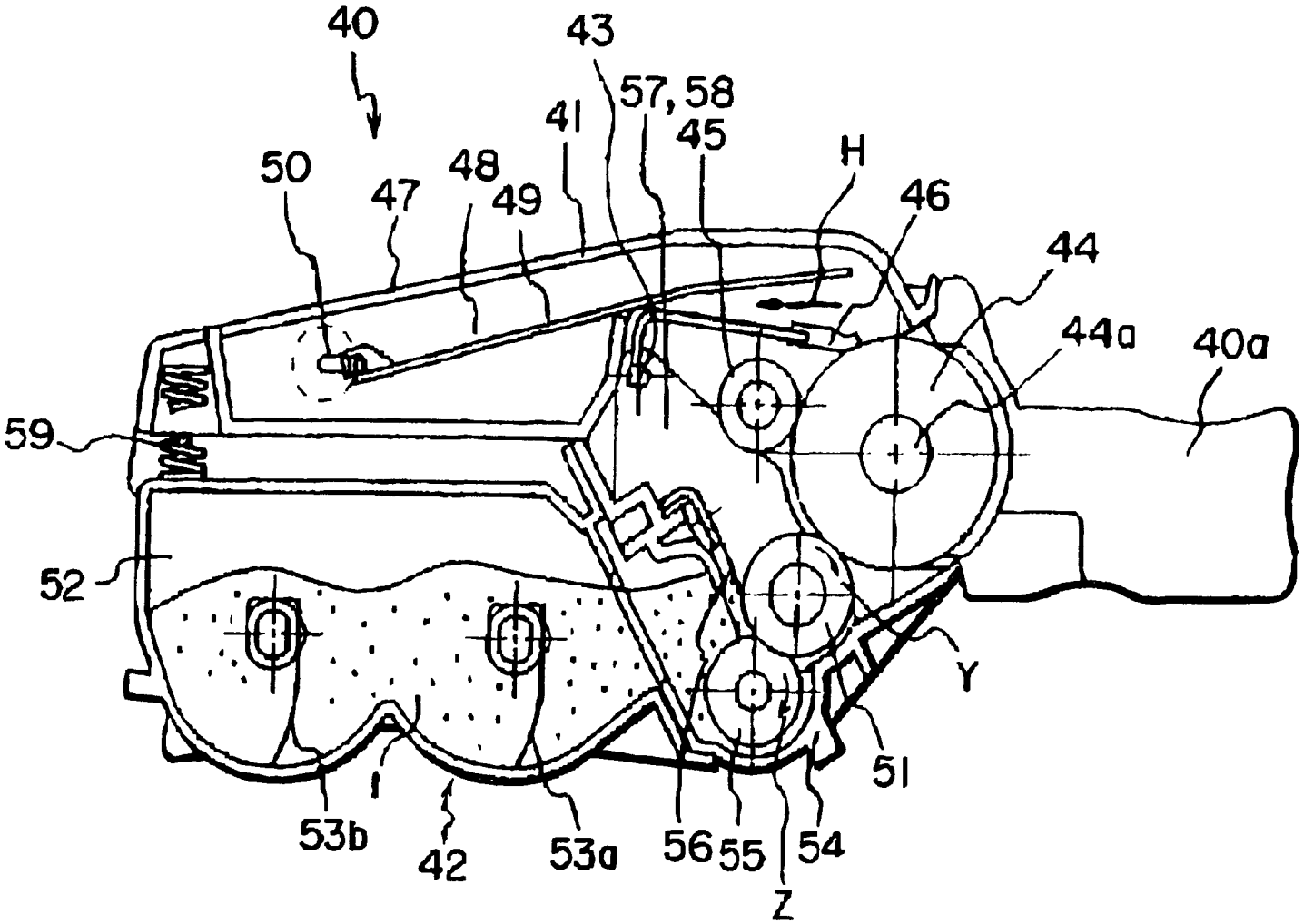
FIG. 8 is a schematic sectional view of the process cartridge in the third embodiment of the present invention.
Figure 9:
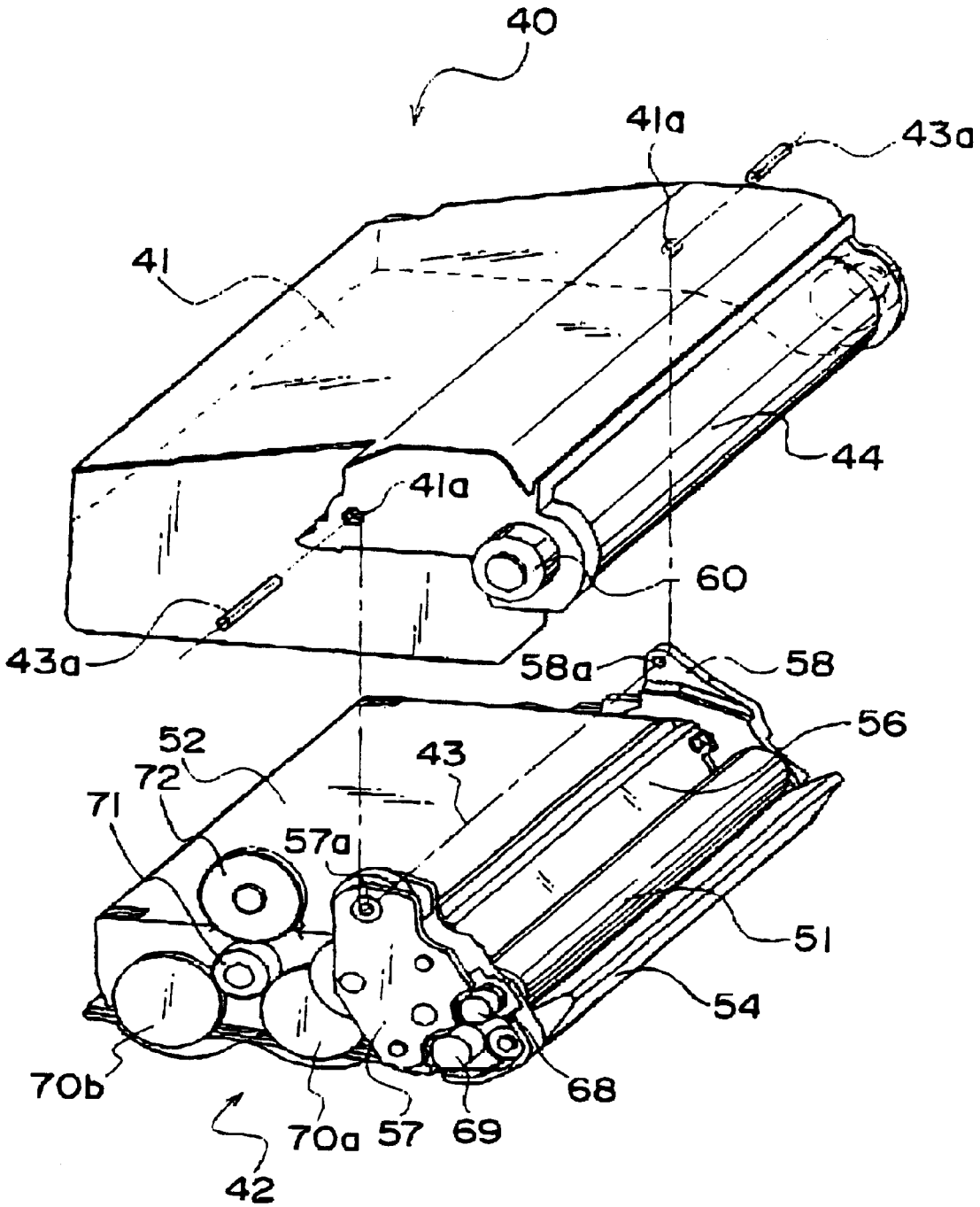
FIG. 9 is a perspective view of the process cartridge in the partially disassembled state.
Figure 10:
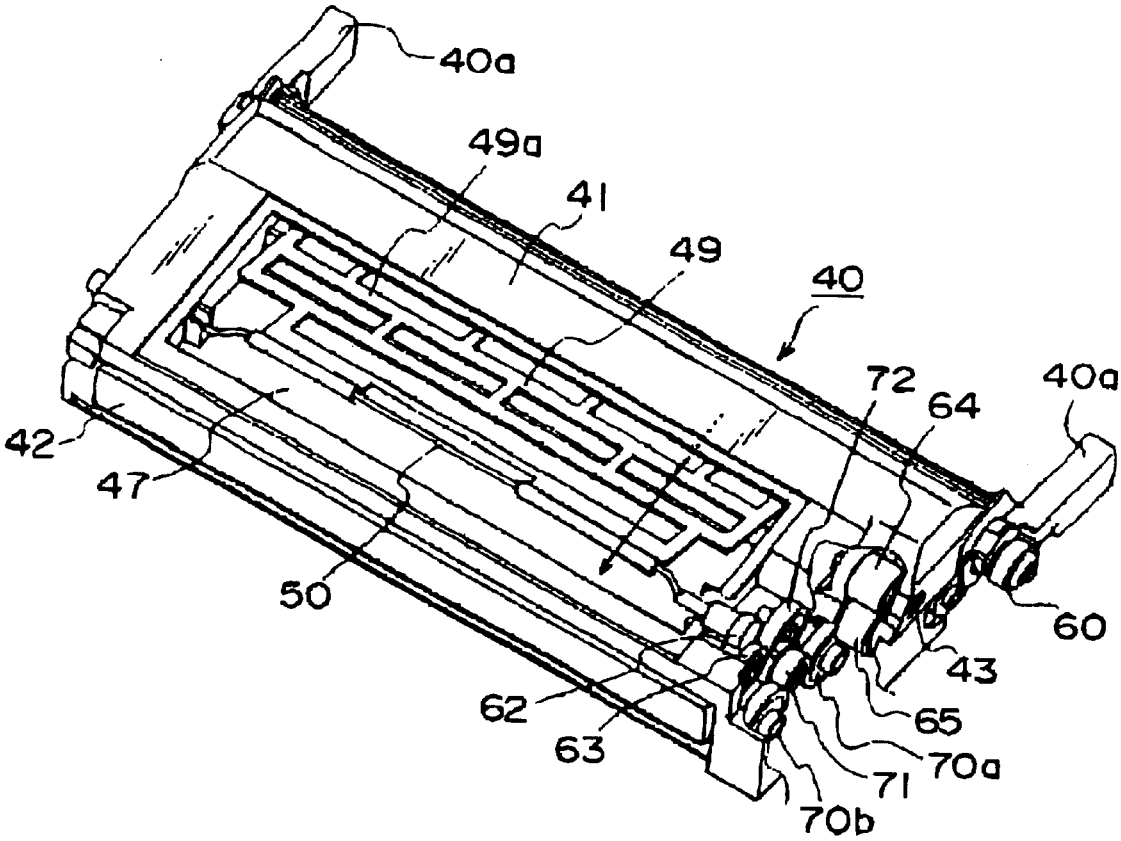
FIG. 10 is a perspective view of the process cartridge as seen from above, with the walls of the removed developer storing portion and driving force transmitting mechanism partially removed.
Figure 11:
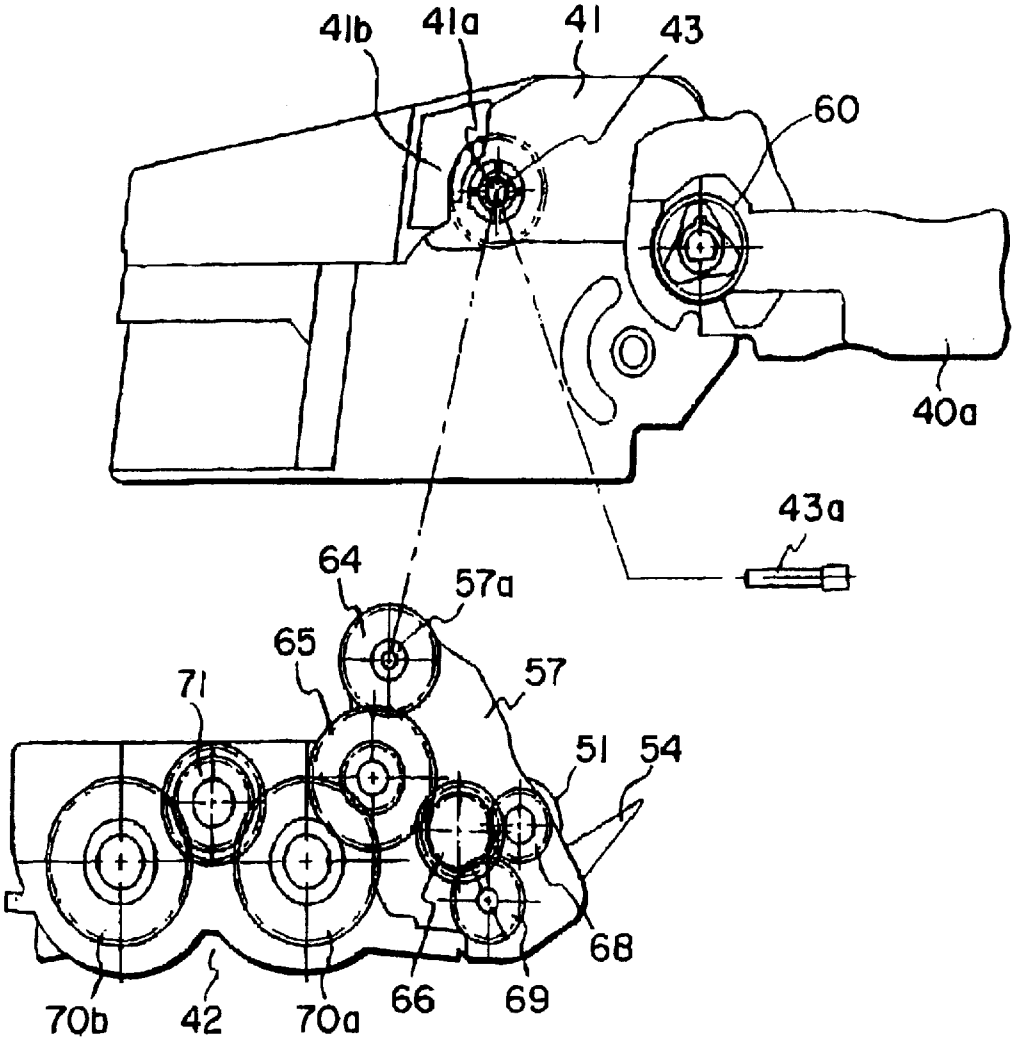
FIG. 11 is a drawing for showing how the first frame portion and second frame portion are joined.
Figure 12:
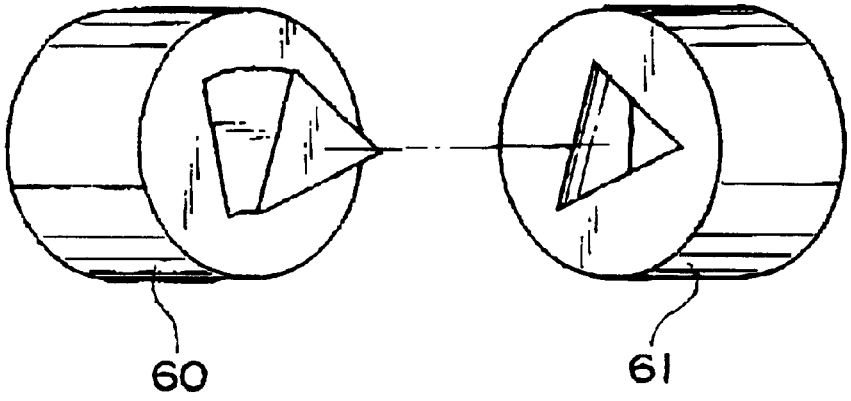
FIG. 12 is a drawing for showing the drum driving force transmitting member on the process cartridge side, and the drum driving force transmitting member on the main assembly side of an image forming apparatus.
Figure 13:
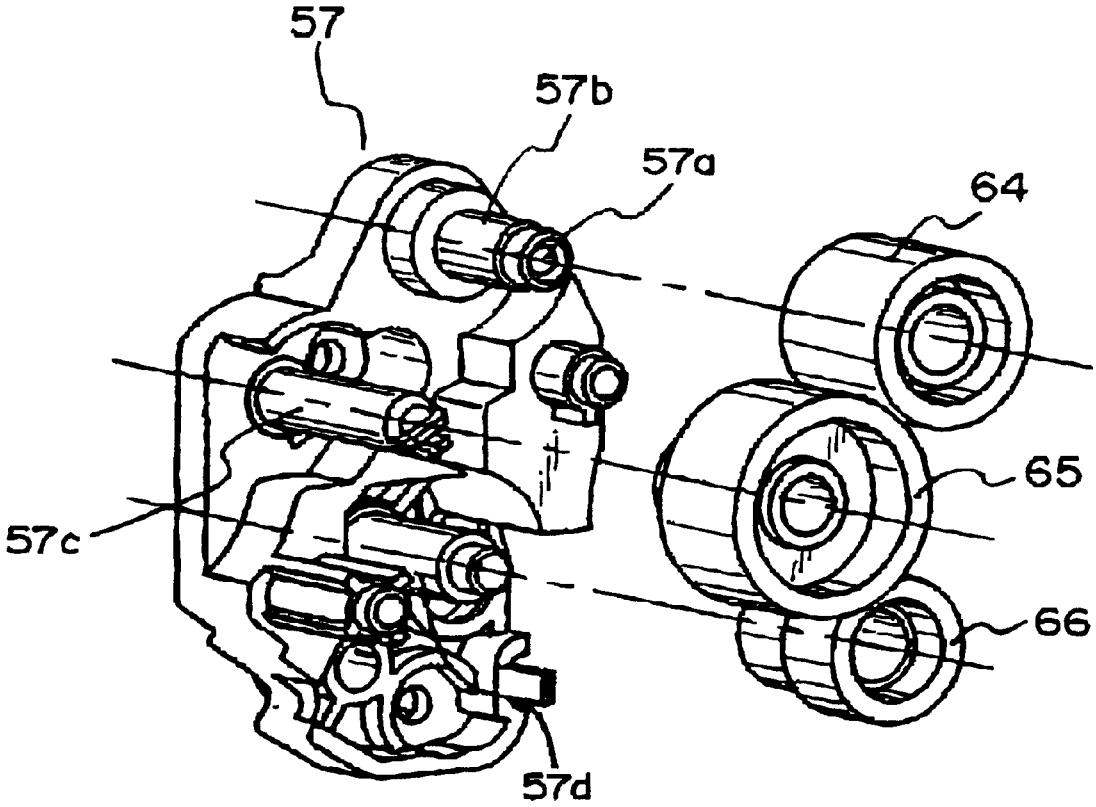
FIG. 13 is a drawing for showing the connecting member of the driving force transmitting mechanism of the development unit.
Figure 14:
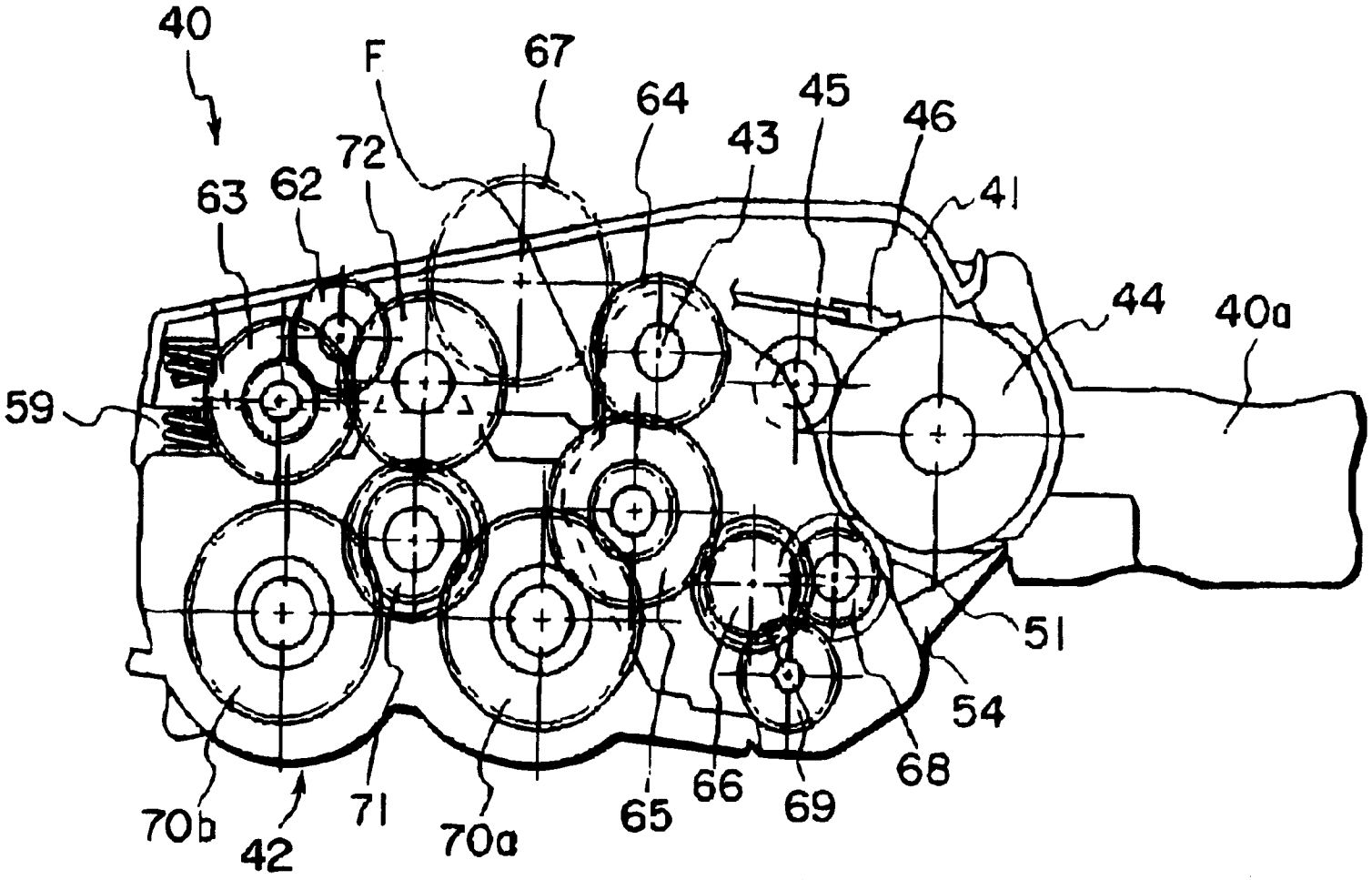
FIG. 14 is a drawing for showing the driving force transmitting mechanism of the process cartridge.
Figure 15:
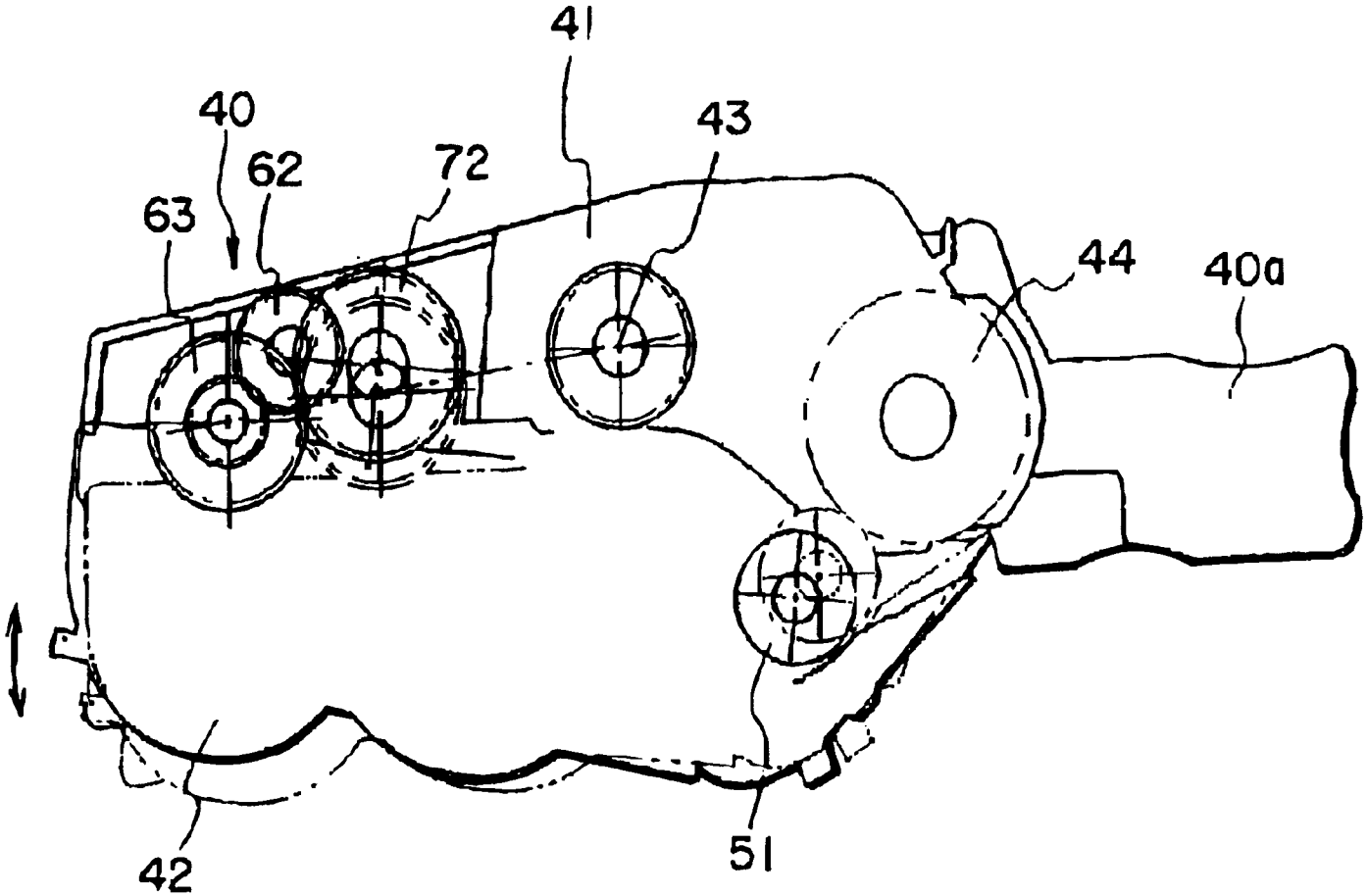
FIG. 15 is a drawing for showing the reaction of the driving force transmitting mechanism when the first frame portion pivots.
Figure 16:
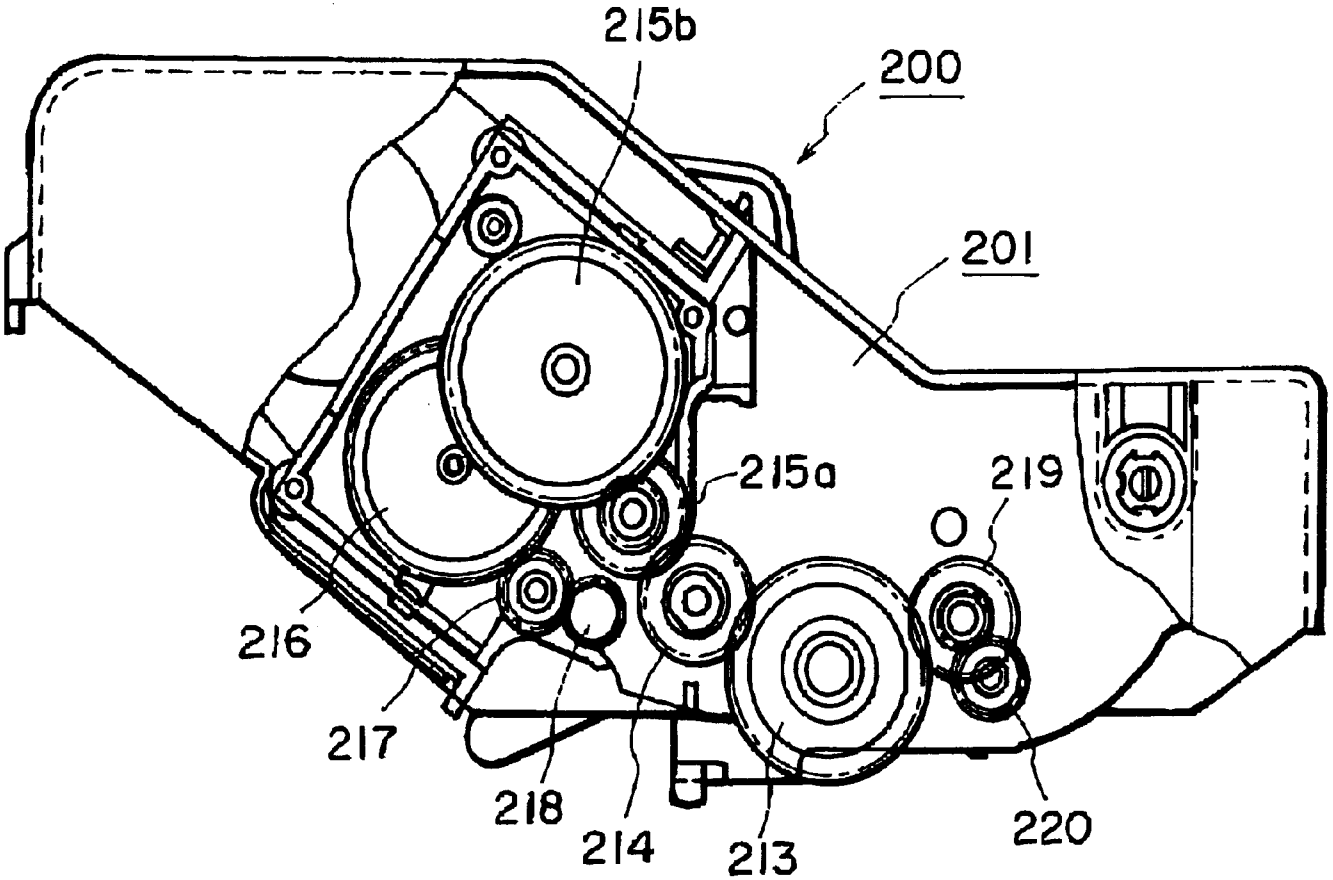
FIG. 16 PRIOR ART
FIG. 16 is a drawing for showing a conventional process cartridge
Figure 17:
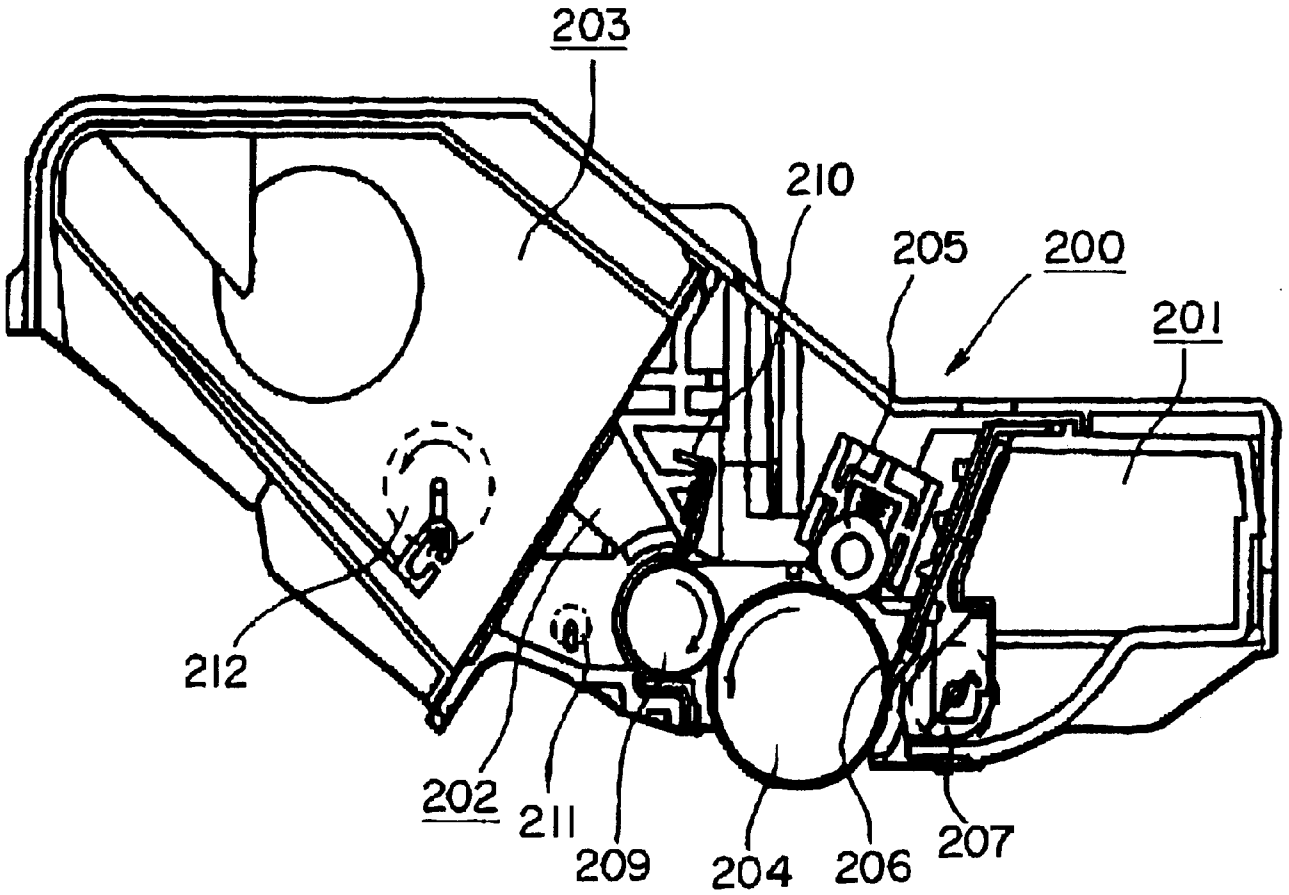
FIG. 17 PRIOR ART
FIG. 17 is a drawing for showing the conventional process cartridge.

The process cartridge and electrophotographic image forming apparatus in this third embodiment of the present invention will be described with reference to the appended drawings. FIG. 7 is a drawing for showing the general structure of the electrophotographic image forming apparatus in this embodiment, and FIG. 8 is a sectional view of the process cartridge in this embodiment. FIG. 9 is a perspective view of the partially disassembled process cartridge in this embodiment, and FIG. 10 is a perspective view of the process cartridge as seen from above, with the walls of the removed developer storing portion and driving force transmission mechanism partially removed FIG. 11 is a drawing for showing how the first and second frame portions are joined, and FIG. 12 is a drawing for showing the drum driving force transmitting portion on the cartridge side and the drum driving force transmitting portion on the apparatus main assembly side. FIG. 13 is a drawing for showing the connecting member of the driving force transmitting mechanism of the development unit, and FIG. 14 is a drawing for showing the driving force transmitting mechanism on the process cartridge side. FIG. 15 is a drawing for showing the reaction of the driving force transmitting mechanism on the process cartridge side when the first frame portion pivots.

(Electrophotographic Image Forming Apparatus)

First, referring to FIG. 7, the overall structure of the electrophotographic image forming apparatus will be described. The image forming apparatus 130 illustrated in FIG. 7 is a full-color laser beam printer which employs an electrophotographic image forming method. In the main assembly 150 of this image forming apparatus 130, four cartridge spaces 150*a*–150*d* are provided, being aligned in the vertical direction, into which cartridges 40 are removably installed. All of the cartridges 40 placed in their own cartridge spaces are exactly the same in structure, but are different in the color of the developer t stored therein. More specifically, the cartridge space 150*a* holds a cartridge 40*a* in which developer t of cyan color is stored; the cartridge space 150*b* holds a cartridge 40*b* in which developer t of yellow color is stored; the cartridge space 150*c* holds a cartridge 40*c* in which developer t of magenta color is stored; and the cartridge space 150*d* holds a cartridge 40*d* in which developer t of black color is stored.

With the four process cartridges 40*a*–40*d* properly placed in the main assembly 150 of the image forming apparatus 130, four photosensitive drums 44*a*–44*d* align in the vertical direction. Photosensitive drums 44 are rotated in the counterclockwise direction in the drawing. Adjacent to the peripheral surfaces of the photosensitive drums 44*a*–44*d*, charge rollers 45*a*–45*d* for uniformly charging the peripheral surfaces of the photosensitive drums 44*a*–44*d*, development unit 42*a*–42*d* for developing an electrostatic latent image; an electrostatic transferring apparatus 134 for transferring the developer image on each photosensitive drum 44 onto a recording medium P, and cleaning members 46*a*–46*d* for removing the developer remaining on the photosensitive drums 44*a*–44*d*, are disposed, correspondingly, in the listed order in terms of the rotational directions of the photosensitive drums 44*a*–44*d*.

Referential codes 131*a*–131*d* designate scanner units which form an electrostatic latent image on the corresponding photosensitive drums 44*a*–44*d* by projecting a laser beam onto the peripheral surface of the corresponding photosensitive drums 44*a*–44*d*, while modulating the laser beam according to image information.

Each cartridge 40 integrally comprises the photosensitive drum 44, a charge roller 45, a development unit 42, and a cleaning member 46. The cartridge 40 will be described later in detail.

The photosensitive drum 44 comprises an aluminum cylinder, for example, with a diameter of 30 mm, and a layer of organic, photoconductive material (OPC based photosensitive drum) coated on the peripheral surface of the aluminum cylinder. The photosensitive drum 44 is rotatably supported, at its longitudinal ends, by supporting members. As a driving force is transmitted to one of the longitudinal ends of the photosensitive drum 44 from a driving motor (unillustrated), the photosensitive drum 44 rotates in the counterclockwise direction in the drawing.

The charge roller 45 is an elastic roller and is of a contact type. In other words, as charge bias is applied to the charge roller 45, with the charge roller 45 placed in contact with the peripheral surface of the photosensitive drum 44, and the peripheral surface of the photosensitive drum 45 is uniformly charged.

The scanner units 131*a*–131*d* are positioned at about the same levels as the corresponding photosensitive drums 44*a*–44*d*. Beams of light modulated with image signals are projected from laser diodes (unillustrated) upon polygon mirrors 132*a*–132*d*, which are being rotated at a high speed. The beams of the image forming light, or the beams of light modulated with image signals, are reflected by the polygon mirrors 132*a*–132*d*, and are focused upon the peripheral surfaces of the photosensitive drum 44*a*–44*d* through focusing lenses 133*a*–133*d*, selectively exposing the peripheral surfaces of the photosensitive drums 44*a*–44*d*. As a result, an electrostatic latent image is formed on the peripheral surface of each of the photosensitive drums 44*a*–44*d*.

As described above, the development unit 42 contains one developer among the yellow, magenta, cyan, and black developers t. The developer is coated on the peripheral surface of the development roller 51, that is, a developing member, while charging the developer. Also, a development bias is applied to the development roller 51 positioned so that the peripheral surface of the development roller 51 becomes microscopically close to, and parallel to, the peripheral surface of the photosensitive drum 44 on which a latent image is present. As a result, developer is transferred onto the peripheral surface of the photosensitive drum 44, across the areas corresponding to the low potential level portions of the electrostatic latent image. Consequently, a developer image is formed (developer) on the photosensitive drum 44.

An endless belt 135 is positioned so that it remains in contact with all of the photosensitive drums 44*a*–44*d* while it is circularly driven. The belt 135 is approximately 700 mm in circumference and is formed of film with a thickness of 150 $\mu$m. It is stretched around four rollers: a driver roller 136, follower rollers 137*a* and 137*b*, and a tension roller 138, and Is circularly driven in the direction indicated by an arrow mark X in the drawing. The recording medium P is kept pressed directly upon the outwardly facing surface of the belt 135 by a roller 144, and electrical voltage is applied between the belt 135 and roller 144 to induce electrical charge between the recording medium P, which is dielectric, and the dielectric layer of the belt 135. As a result, the recording medium P is electrostatically adhered to the outwardly facing surface of the belt 135, assuring that the recording medium P is conveyed, being kept properly positioned, to the interface (transfer station) between the belt 135 and the photosensitive drum 44.

Within the loop of the belt 135, transfer rollers 139*a*–139*d* are positioned, being kept in contact with the belt 135, at the points corresponding to the photosensitive drums 44*a*–44*d*, by a predetermined amount of pressure. Positive electrical charge is applied from these transfer rollers 139 to the recording medium P through the belt 135. The developers images on the photosensitive drums 44*a* 20 44*d*, which are negative in polarity, are transferred one after another onto the recording medium P while the recording medium P is conveyed in contact with the photosensitive drums 44*a*–44*d*, by the electrical fields generated by these electrical charges.

A conveying portion 140 is a portion for conveying the recording medium P. In a sheet feeding cassette 141, plural sheets of recording medium are stored. During an image forming operation, a feeding roller 142 is rotationally driven to feed out the plural sheets of recording medium and convey them forward, one by one, in coordination with the progression of the image forming operation. As the recording medium P is conveyed, it bumps against a pair of registration rollers 143, being thereby straightened if it were skewed. Then, the recording medium P is released to the belt 135 by the pair of registration rollers 143 in synchronism with the rotation of the belt 135, that is, in synchronism with the leading edges of the developer images on the photosensitive drums 44*a*–44*d*. More specifically, the pair of registration rollers 143 begins to be rotated with such a timing that the leading edge of the developer image on the photosensitive drum 44*a*, or the most upstream photosensitive drum, arrives at the interface between the photosensitive drum 44*a* and belt 135, at the same time as the leading edge of the recording area of the recording medium P on the belt 135 arrives at the interface between the photosensitive drum 44*a* and belt 135.

After the transfer of the developer image onto the recording medium P, the recording medium P separates from the belt 135 due to the curvature of the driving roller 136, and is conveyed into a fixing station 145, which is where the plural developer images on the recording medium P are fixed to the recording medium P. More specifically, the fixing station 145 comprises a heat roller 146, and a pressure roller 147 which is kept pressed upon the heat roller 146 to assure that heat and pressure is properly applied to the recording medium P. As the recording medium P, on which the transferred developer images are borne unfixed, is passed through the fixing station 145, the developer is melted by the heat and fixed as a full-color image to the recording medium P by the pressure. After the fixation of the developer images, or the formation of the full-color image, the recording medium P is discharged out of the apparatus main assembly through a delivery station 149 by a pair of discharge rollers 148.

(Process Cartridge)

Next, referring to FIGS. 8–15, the cartridge 40 (40*a*–40*d*) in this embodiment will be described. This cartridge 40 comprises a drum unit 41, which is enclosed in the first frame portion, and a development unit 42, which is enclosed in the second frame portion. As will be described later, the two units are connected by a pair of pins so that the two units are rendered pivotal relative to each other about a pivotal axis 43 which coincides with the axes of the pair of pins.

(First Frame Portion)

Referring to FIG. 8, the drum unit 41 enclosed in the first frame portion contains a photosensitive drum 44, which is rotatably supported by the drum unit 41 with the use of a shaft 44*a*. In addition, the drum unit 41 contains a charge roller 45 for uniformly charging the peripheral surface of the photosensitive drum 44, a cleaning member 46 for removing the developer remaining on the photosensitive drum 44 by making contact with the photosensitive drum 44, a removed developer storing portion 47 located above a developer storing portion 52, which will be described later, and a removed developer conveying mechanism 48. Further, the drum unit 41 has a pair of holes 41*a* (FIG. 9) for connecting the drum unit 41 and development unit 42. The center lines of the holes 41*a* coincide with the pivotal axis 43.

Incidentally, a term "above" is used with reference to such a condition that the cartridge 40 is properly seated in the apparatus main assembly 150.

As described above, the developer which remains on the photosensitive drum 44 after image transfer is scraped away by the cleaning member 46, and the removed developer is conveyed into the removed developer storing portion 47 by the removed conveying mechanism 48.

The removed developer conveying mechanism 48 is provided with a developer advancing plate 49, or a removed developer conveying member, which is rotatably attached to a crank 50 rotatably supported by the removed developer storing portion 47. The crank 50 is formed of a piece of metallic rod, and has a rotational diameter of 5 mm. The rotation of the crank 50 causes the developer advancing plate 49 to reciprocally move in the direction (direction H indicated by arrow mark in FIG. 10) to convey the removed developer from the adjacencies of the cleaning member 46 to the removed developer storing portion 47. The developer advancing plate 49 is a piece of metallic plate with a thickness of 1 mm, and is provided with partitions 49*a* for conveying the developer forward.

Incidentally, a screw may be employed as the removed developer conveying member, although the developer advancing plate 49 is employed in this embodiment.

(Second Frame Portion)

Referring to FIG. 8, the development unit 42 enclosed in the second frame portion is provided with a development roller 51 as a developing member, a developer storing portion 52 which stores developer of relevant color. and a frame portion 54 for developing means. The developer storing portion 52 is located below the removed developer storing portion 47, and contains stirring members 53*a* and 53*b* which double as a developer sending means.

Incidentally, a term "below" is used with reference to a condition in which the cartridge 40 is properly seated in the apparatus main assembly.

The developer in the developer storing portion 52 is delivered to a developer supplying roller 55 within the developing means frame portion 54 by a stirring member 53. Then, the developer is adhered to the peripheral surface of the development roller 51, which is rotating in the clockwise direction (direction of arrow mark Y), by the developer supplying roller 55, which is rotating in the clockwise direction (direction of arrow mark Z), and a development blade 56 kept pressed upon the peripheral surface of the development roller 51. As the developer is adhered to the peripheral surface of the development roller 51, it is given electrical charge.

(Connection Between First and Second Frame Portions)

Referring to FIG. 9, the development unit 42 (second frame portion) is provided with a pair of bearing members 57 and 58, which are located at the longitudinal ends of the development unit 42 (longitudinal ends of development roller 51), one for one, for keeping the development unit 42 connected to the drum unit 41 (first frame portion). The bearing members 57 and 58 are provided with holes 57*a* and 58*a* with a bearing surface, respectively. The central axes of the holes 57*a* and 58*a* coincide with the pivotal axis 43. Through these holes 57*a* and 58*a*, pins 43*a* are inserted into the holes 41*a* with which the drum unit 41 is provided, from the outward side of the bearing members 57 and 58. As a result, the drum unit 41 and development unit 42 are connected in such a manner that they become pivotal relative to each other as shown in FIG. 11. Further, the provision of a pair of compression springs 59, which will be described later, between the two units assures that the peripheral surfaces of the photosensitive drum 44 and development roller 51 remain in contact with each other across the entire ranges of the two rollers in terms of their longitudinal directions.

More specifically, the pair of compression springs 59 are placed between the drum unit 41 and development unit 42, as shown in FIG. 8, so that the photosensitive drum 44 and development roller 51 are kept pressed upon each other by the elasticity of the compression springs 59.

(Driving Force Transmitting Mechanism)

Next, the driving force transmitting mechanism in the cartridge 40 will be described. In this embodiment, the driving force is independently transmitted to the drum unit 41 and development unit 42 of the cartridge 40, from the apparatus main assembly.

Referring to FIG. 9, the drum unit 41 is provided with a drum driving coupling 60, as a drum driving force transmitting member on the cartridge side, which is located at the longitudinal end of the photosensitive drum 44. The axial line of the drum driving coupling 60 coincides with that of the photosensitive drum 44. To this drum driving coupling 60, the driving force is transmitted from a coupling 61, as the driving force transmitting member, on the apparatus main assembly side.

Referring to FIG. 12, the coupling 60 on the cartridge side is in the form of a twisted, approximately equilateral, and triangular pillar, whereas the coupling 61 on the main assembly side is in the form of a twisted, approximately equilateral, and triangular hole. The cartridge side coupling 60 engages into the main assembly side coupling 61 in the direction parallel to the longitudinal direction of the photosensitive drum 44. Then, as the main assembly side coupling 61 begins to rotate, the engagement of the cartridge side coupling 60 into the main assembly side coupling 61 becomes gradually deeper, following the twisted, equilateral, and triangular structures of the two coupling portions. By the time the apparatus side coupling 61 finishes rotating a maximum of 120 degrees, two couplings fully engage with each other, and the driving force begins to be transmitted to the photosensitive drum 44. Incidentally, the rotational axis of the cartridge side coupling 60 coincides with the rotational axis of the photosensitive drum 44.

Further, the drum unit 41 has a gear 62 attached to the shaft of the crank 50 of the removed developer conveying mechanism 48, and an idler gear 63 meshed with the gear 62 (FIG. 14).

The bearing member 57, that is, the bearing member on the driven side, of the development unit 42 is provided with shafts 57*b*–54*d*, around which a gear 64, and idler gear 65 and 66, as developing means driving force transmitting members, are fitted, correspondingly. The gear 64 is a helical gear, and driving force is transmitted to this gear 64 from a helical gear 67 as d developing means driving force transmitting member on the main assembly side, as shown in FIG. 14. Incidentally, in terms of the direction perpendicular to the direction in which the cartridge 40 is inserted into the apparatus main assembly 150, the gear 46 is located at the same side of the cartridge 40 as the aforementioned cartridge side coupling 60. Also in terms of the direction perpendicular to the direction in which the cartridge 40 is inserted into the apparatus main assembly 150, the gear 64 is on the inward side the cartridge side coupling 60. Also in terms of the direction in which the cartridge 40 is inserted into the apparatus main assembly 150, the gear 64 is on the downstream side of the cartridge side coupling 60.

Incidentally, the cartridge 40 is inserted into, or removed from, the apparatus main assembly 150 in the direction perpendicular to the axial line of the photosensitive drum 44.

The axial line of the shaft 57*b* coincides with the axial line of the through hole 57*a*, the axial line of which coincides with the pivotal axis 43. The gear 64 is positioned so that its axial line coincides with the axial lines (in other words, pivotal axis 43) of the aforementioned connecting pins 43*a* by which the drum unit 41 and development unit 42 remain connected to each other.

To sum up, the cartridge 40 in this embodiment comprises: the drum unit 41; the development unit 42 connected to the drum unit 41 with the use of the pins 43*a* in such a manner that the development unit 42 is rendered pivotal about the pins 43*a*; the photosensitive drum 44 with which the drum unit 41 is provided; the development roller 51 provided in the development unit 42 to develop the electrostatic latent image formed on the photosensitive drum 44, with the use of the developer t; and the gear 64 as a developing means driving force transmitting member for receiving the driving force for rotating the development roller 51, from the apparatus main assembly 150, when the cartridge 40 is in the apparatus main assembly 150. The gear 64 is positioned in such a manner that its axial line coincides with that of the aforementioned pins 43*a*. It receives a driving force from a direction approximately perpendicular to the longitudinal direction of the development roller 51. It meshes with the aforementioned helical gear 67, that is, one of the gears on the main apparatus side, which is provided in the apparatus main assembly 150, on the downstream side with respect to the axial line of the gear 64 in terms of the direction in which the cartridge 40 is inserted into the apparatus main assembly 150. It should be noted here that as described above, the cartridge 40 is inserted into the apparatus main assembly 150 from the direction perpendicular to the axial line of the development roller 51; the gear 64 is provided in the development unit 42; the gear 64 is exposed through the opening 41*b* of the drum unit 41; and the gear 64 meshes with the helical gear 67 by the exposed portion.

Incidentally, the direction from which the cartridge side coupling 60, as a drum driving force transmitting member, receives a driving force from the apparatus main assembly 150 is perpendicular to the direction from which the gear 64 receives a driving force from the apparatus main assembly 150. With the provision of the above described structure arrangement, when a driving force is inputted into the gear 64, the moment generated about the pivotal axis 43 by the force F generated by the meshing between the helical gear 67 and gear 64 remains small. In other words, positioning the gear 64 in such a manner that the axial line of the gear 64 coincides with the axial lines of the pins 43*a* which connect the drum unit 41 and development unit 42, prevents the position of the development unit 42 from changing. This, in turn, prevents the backlash between the gear 64 and helical gear 67 from changing. As a result, a stable image forming operation is possible. Further, when driving force is transmitted from the apparatus main assembly 150 to the development unit 42, the moment which otherwise will be generated as the driving force is inputted from the apparatus main assembly 150, is not generated, and therefore, an unsatisfactory image, the cause of which is traceable to cartridge-frame deformation, is not produced.

After being inputted into the gear 64, the driving force is divisively transmitted. In other words, a part of the driving force inputted into that is transmitted to the development roller 51, and the stirring member 53, as well as the removed developer conveying mechanism 48 of the drum unit 41, by way of driving force transmitting means, or the gear trains.

More specifically, after being inputted into the gear 64, a part of the driving force is transmitted to the gear 68 attached to one end of the development roller 51, and the gear 69 attached to one end of the developer supplying roller 55, by way of the idler gear 65 and 66 which make up the first gear train, and rotates the development roller 51 and developer supplying roller 55. Incidentally, the idler gear 65 is a step gear, and reduces the rotational velocity of driving force.

Another part of driving force is transmitted to the developer stirring gear 70*a* of the stirring member 53*a* to rotate the stirring member 53*a*, and then is further transmitted, by way of the idler gear 71, to the developer stirring gear 70*b* of the stirring member 53*b* to rotate the stirring member 53*b*.

From the idler gear 71, the driving force is divisively transmitted. That is, a part of the driving force delivered to the idler gear 71 is transmitted to the idler gear 63 of the drum unit 41 through the idler gear 72. As described above, the idler gear 63 is meshed with the gear 62 attached to the crank 50 of the removed developer conveying mechanism 48, and therefore, transmits the driving force to the crank 50, which in turn transmits the driving force to the developer advancing plate 49. In other words, a part of the driving force inputted into the gear 64 of the development unit 42 is transmitted to the developer advancing plate 49, that is, the removed developer conveying member of the drum unit 41, by way of the driving force transmitting means, that is, the gear train (gears 65, 70*a*, 71, 72, 63 and 62), and reciprocally moves the developer advancing plate 49. The idler gears 71 and 63 are stepped, and reduce the rotational velocity of driving force.

It should be noted here that the gears 70*a*, 71, 70*b*, 72, 62 and 63 make up the second gear trains. The gears 64, 65, 66, 68, 69, 70*a*, 70*b*, 71 and 72 are attached to development unit 42, and the gears 67, 62 and 63 are attached to the drum unit 41.

As described above, according to this embodiment, the means for driving the photosensitive drum 44 is rendered separate from the system for driving the development roller 51, the stirring member 53, and the developer advancing plate 49. Therefore, it does not occur that the fluctuations in the rotational velocity, and vibrations, of the stirring member 53 and developer advancing plate 49, are directly transmitted to the photosensitive drum 44. Thus, even when the accumulation of the removed developer results in the increased load upon the developer advancing plate 49, the rotation of the photosensitive drum 44 is not affected by the increase.

Further, the development unit 42 pivots relative to the drum unit 41. Thus, the idler gear 72 of the development unit 42 also pivots relative to the idler gear 63 of the drum unit 41. Therefore, a structural arrangement is made to place the pivotal axis 43, and the axial lines of the idler gears 72 and 63, in the same plane as shown in FIG. 15. With this arrangement, the idler gears 72 and 63 do not interfere with the pivoting of the development 42 relative to the drum unit 41, and the backlash between the two gears becomes minimum.

The cartridge 40 is provided with an handle 40*a*, which is located on the photosensitive drum side. This handle 40*a* is grasped by a user to install, or remove, the cartridge 40 into, or from, one of the aforementioned cartridge spaces 150*a*–150*d* in a direction perpendicular to the axial line of the photosensitive drum 44. Thus, in terms of the direction in which the cartridge 40 is inserted into the apparatus main assembly 150, the gear 64 is positioned on the downstream side of the cartridge side coupling 60. Also in terms of the direction in which the cartridge 40 is inserted into the apparatus main assembly 150, the photosensitive drum 44, the development roller 51, and the crank 50 for driving the developer advancing plate 49, are positioned in the listed order, listing from the upstream side.

In this embodiment, the through hole 57*a*, through which the shaft for the gear 64 is put, and the center line of which coincides with the pivotal 5 axis 43, is provided in the bearing member 57. However, a similar structure may be placed in the developing means frame portion 54, or the developer storing portion 52 instead of the bearing member 57.

With the provision of the above described structural arrangements, a process cartridge, and an image forming apparatus, in accordance with the present invention, do not suffer from the problem that the increase in the load placed upon the removed developer conveying member by the accumulation of the removed developer affects the rotation of the photosensitive drum.

While the invention has been described with reference to the structures disclosed herein, it is not confined to the details set forth and this application is intended to cover such modifications or changes as may come within the purposes of the improvements or the scope of the following claims.

What is claimed is:

1. A process cartridge detachably mountable to a main assembly of an electrophotographic image forming apparatus comprising:

a first frame;

a second frame rotatably coupled with said first frame;

an electrophotographic photosensitive drum provided in said first frame;

a developing member, provided in said second frame, for developing an electrostatic latent image formed on said photosensitive drum with a developer;

a cleaning member, provided in said first frame, for removing the developer remaining on said photosensitive drum;

a removed developer feeding member, provided in said first frame, for transporting the developer removed by said cleaning member;

a drum driving force receiving member, provided in said first frame, for receiving, from the main assembly of the apparatus, a driving force for rotating said photosensitive drum when said process cartridge is mounted to the main assembly of the apparatus;

a development driving force receiving member, provided in said second frame, for receiving, from the main assembly of said apparatus, a driving force for rotating said developing member when said process cartridge is mounted to the main assembly of the apparatus; and a driving force transmitting member, provided in said second frame, for transmitting, to said removed developer feeding member, the driving force received from the main assembly of the apparatus by the development driving force receiving member to rotate said removed developer feeding member.

2. A process cartridge according to claim 1, wherein said development driving force receiving member includes a gear, wherein the driving force received by said gear is transmitted to said removed developer feeding member by a gear train as said driving force transmitting member to rotate said removed developer feeding member.

3. A process cartridge according to claim 2, wherein said gear train transmits the driving force to a stirring member provided in a developer accommodating portion for accommodating the developer to be used for development to rotate said stirring member, wherein said developer accommodating portion and said stirring member are provided in said second frame.

4. A process cartridge according to claim 1, wherein said development driving force receiving member is disposed downstream of said drum driving force receiving member with respect to a mounting direction of mounting said process cartridge to the main assembly of the apparatus, and wherein said development driving force receiving member and said drum driving force receiving member are provided in the same side with respect to a direction crossing with the mounting direction, and said process cartridge is mounted to the main assembly of the apparatus in the direction crossing with an axial direction of said photosensitive drum.

5. A process cartridge according to claim 4, wherein said drum driving force receiving member is in the form of a coupling, and said development driving force receiving member is in the form of a helical gear, and wherein said helical gear is disposed inside said coupling in the direction crossing with the mounting direction.

6. A process cartridge according to claim 1, wherein said development driving force receiving member is disposed downstream of said drum driving force receiving member with respect to the mounting direction of mounting said process cartridge to the main assembly of apparatus, and wherein said photosensitive drum, a developing roller as said developing member and a crank for driving said removed developer feeding member are arranged in the order named from an upstream side toward a downstream side with respect to the mounting direction.

7. A process cartridge according to claim 6, wherein said first frame is provided with a developer accommodating portion for accommodating a developer to be used for development, wherein a removed developer accommodating portion for accommodating in the removed developer is disposed so as to he above said developer accommodating portion when said process cartridge is mounted to the main assembly of the apparatus, and wherein said removed developer feeding member is disposed in said removed developer accommodating portion.

8. A process cartridge according to claim 1 or 3, wherein said drum driving force receiving member is a cartridge coupling which is engageable with a main assembly coupling provided in the main assembly of the apparatus in the direction along a longitudinal direction of said photosensitive drum and receives a driving force for rotating said photosensitive drum.

9. A process cartridge according to claim 8, wherein said cartridge coupling is in the form of a substantially twisted triangular prism, and said main assembly coupling is a twisted hole having a substantially triangular shape cross-section, and wherein the driving force is transmitted through engagement between the twisted triangular prism and the twisted hole.

10. A process cartridge detachably mountable to a main assembly of an electrophotographic image forming apparatus comprising:

a first frame;

a second frame rotatably coupled with said first frame;

an electrophotographic photosensitive drum provided in said first frame;

a developing member, provided in said second frame, for developing an electrostatic latent image formed on said photosensitive drum with a developer;

a cleaning member, provided in said first frame, for removing the developer remaining on said photosensitive drum;

a removed developer feeding member, provided in said first frame, for transporting the developer removed by said cleaning member;

a drum driving force receiving member, provided in said first frame, for receiving, from the main assembly of the apparatus, a driving force for rotating said photosensitive drum when said process cartridge is mounted to the main assembly of the apparatus;

a development driving force receiving member, provided in said second frame, for receiving, from the main assembly of said apparatus, a driving force for rotating said developing member when said process cartridge is mounted to the main assembly of the apparatus; and a driving force transmitting member, provided in said second frame, for transmitting, to said removed developer feeding member, the driving force received from the main assembly of the apparatus by the development driving force receiving member to rotate said removed developer feeding member, wherein said development driving force receiving member is disposed downstream of said drum driving force receiving member with respect to a mounting direction of mounting said process cartridge to the main assembly of the apparatus, and wherein said development driving force receiving member and said drum driving force receiving member are provided in the same side with respect to a direction crossing with the mounting direction, and said process cartridge is mounted to the main assembly of the apparatus in the direction crossing with an axial direction of said photosensitive drum, wherein said drum driving force receiving member is in the form of a coupling, and said development driving force receiving member is in the form of a helical gear, and wherein said helical gear is disposed inside said coupling in the direction crossing with the mounting direction, and wherein said first frame and second frame are rotatably coupled by a shaft, and said helical gear is coaxial with the shaft.

11. A process cartridge according to claim 10, wherein said development driving force receiving member is disposed downstream of said drum driving force receiving member with respect to the mounting direction of mounting said process cartridge to the main assembly of apparatus, and wherein said photosensitive drum, a developing roller as said developing member and a crank for driving said removed developer feeding member are arranged in the order named from an upstream side toward a downstream side with respect to the mounting direction.

12. A process cartridge according to claim 11, wherein said first frame is provided with a developer accommodating portion for accommodating a developer to be used for development, wherein a removed developer accommodating portion for accommodating in the removed developer is disposed so as to be above said developer accommodating portion when said process cartridge is mounted to the main assembly of the apparatus, and wherein said removed developer feeding member is disposed in said removed developer accommodating portion.

13. A process cartridge detachably mountable to a main assembly of an electrophotographic image forming apparatus comprising:

a first frame which is disposed such that it takes a relatively upper position when said process cartridge is mounted to the main assembly of the apparatus;

a second frame coupled with said first frame for rotation about a shaft, wherein said second frame is disposed such that it takes a relatively lower position when said process cartridge is mounted to the main assembly of the apparatus;

an electrophotographic photosensitive drum provided in said first frame;

a developing roller, provided in said second frame, for developing an electrostatic latent image formed on said photosensitive drum with a developer;

a developer accommodating portion, provided in said second frame, for accommodating the developer;

a cleaning member, provided in said first frame, for removing the developer remaining on said photosensitive drum;

a removed developer feeding member, provided in said first frame, for transporting the developer removed by said cleaning member;

a removed developer accommodating portion, provided in said first frame, for accommodating the developer removed by said cleaning member, said removed developer feeding member being disposed in said removing developer accommodating portion and being disposed such that it takes a position above said developer accommodating portion when said process cartridge is mounted to the main assembly of the apparatus;

a cartridge coupling, provided in said first frame, to receiving, from the main assembly of apparatus, the driving force for rotating said photosensitive drum when said process cartridge is mounted to the main assembly of the apparatus, wherein said cartridge coupling is disposed coaxially with said photosensitive drum;

a cartridge helical gear, provided in said second frame, for receiving, from the main assembly of the apparatus, a driving force for rotating said developing roller when said process cartridge is mounted to the main assembly of the apparatus, wherein said cartridge helical gear is disposed downstream of said cartridge coupling with respect to a mounting direction of mounting said process cartridge to the main assembly of the apparatus, and wherein said cartridge helical gear disposed coaxially with said shaft, and said cartridge helical gear disposed inside of a position of said cartridge coupling with respect to a direction crossing with the mounting direction; and a gear train, provided in said second frame, for transmitting, to said removed developer feeding member, the driving force received from the main assembly of the apparatus by the cartridge helical gear to rotate said removed developer feeding member;

wherein said photosensitive drum, said developing roller and a crank for driving said removed developer feeding member are disposed in the order named from an upstream side to a downstream side with respect to the mounting direction, and wherein said cartridge helical gear and said cartridge coupling are disposed at the same side with respect to a direction crossing with the mounting direction, and wherein said process cartridge is mounted to the main assembly of the apparatus in a direction crossing with an axis of said photosensitive drum.

14. A process cartridge according to claim 13, wherein said cartridge coupling is in the form of a substantially twisted triangular prism, and a main assembly coupling for transmitting the driving force to said cartridge coupling is a twisted hole having a substantially triangular shape cross-section, and wherein the driving force is transmitted through engagement between the twisted triangular prism and twisted hole.

15. A process cartridge according to claim 13 or 14, further comprising a stirring member for stirring the developer accommodated in said developer accommodating portion, wherein stirring member is accommodated in said developer accommodating portion and receives the driving force from said gear train.

16. A process cartridge according to claim 1 or 13, wherein a rotational center of said first frame and said second frame, a gear of said driving force transmitting member provided in said second frame, and a gear which is provided in said first frame and which is in meshing engagement with said gear of said driving force transmitting member, are substantially on a line.

17. An electrophotographic image forming apparatus for forming an image on a recording material, to which a process cartridge is detachably mountable, said apparatus comprising:

(i) a main assembly drum driving force transmitting member;

(ii) a main assembly development driving force transmitting member;

(iii) a mounting portion for detachably mounting a process cartridge, said process cartridge including:

a first frame;

a second frame rotatably coupled with said first frame;

an electrophotographic photosensitive drum provided in said first frame;

a developing member, provided in said second frame, for developing an electrostatic latent image formed on said photosensitive drum with a developer;

a cleaning member, provided in said first frame, for removing the developer remaining on said photosensitive drum;

a removed developer feeding member, provided in said first frame, for transporting the developer removed by said cleaning member;

a drum driving force receiving member, provided in said first frame, for receiving, from the main assembly drum driving force transmitting member, a driving force for rotating said photosensitive drum when said process cartridge is mounted to the main assembly of the apparatus;

a development driving force receiving member, provided in said second frame, for receiving, from the main assembly development driving force transmitting member, a driving force for rotating said developing member when said process cartridge is mounted to the main assembly of the apparatus; and a driving force transmitting member, provided in said second frame, for transmitting, to said removed developer feeding member, the driving force received from the main assembly of the apparatus by the development driving force receiving member to rotate said removed developer feeding member.

18. An electrophotographic image forming apparatus for forming an image on a recording material, to which a process cartridge is detachably mountable, said apparatus comprising:

(i) a main assembly coupling;

(ii) a main assembly helical gear;

(iii) a mounting portion for detachably mounting a process cartridge, said process cartridge including:

a first frame which is disposed such that it takes a relatively upper position when said process cartridge is mounted to the main assembly of the apparatus;

a second frame coupled with said first frame for rotation about a shaft, wherein said second frame is disposed such that it takes a relatively lower position when said process cartridge is mounted to the main assembly of the apparatus;

an electrophotographic photosensitive drum provided in said first frame;

a developing roller, provided in said second frame, for developing an electrostatic latent image formed on said photosensitive drum;

a developer accommodating portion, provided in said second frame, for accommodating the developer;

a cleaning member, provided in said first frame, for removing the developer remaining on said photosensitive drum;

a removed developer feeding member, provided in said first frame, for transporting the developer removed by said cleaning member;

a removed developer accommodating portion, provided in said first frame, for accommodating the developer removed by said cleaning member, said removed developer feeding member being disposed in said removed developer accommodating portion and being disposed such that it takes a position above said developer accommodating portion when said process cartridge is mounted to the main assembly of the apparatus;

a cartridge coupling, provided in said first frame, to receive, from said main assembly coupling, the driving force for rotating said photosensitive drum when said process cartridge is mounted to the main assembly of the apparatus, wherein said cartridge coupling is disposed coaxially with said photosensitive drum;

a cartridge helical gear, provided in said second frame, for receiving, from said main assembly helical gear, a driving force for rotating said developing roller when said process cartridge is mounted to the main assembly of the apparatus, wherein said cartridge helical gear is disposed downstream of said cartridge coupling with respect to a mounting direction of mounting said process cartridge to the main assembly of the apparatus, and wherein said cartridge helical gear is disposed coaxially with said shaft, and said cartridge helical gear is disposed inside of a position of said cartridge coupling with respect to a direction crossing with the mounting direction; and a gear train, provided in said second frame, for transmitting, to said removed developer feeding member, the driving force received from the main assembly of the apparatus by the helical gear to rotate said removed developer feeding member;

wherein said photosensitive drum, said developing roller and a crank for driving said removed developer feeding member are disposed in the order named from an upstream side to a downstream side with respect to the mounting direction, and wherein said cartridge helical gear and said cartridge coupling are disposed at the same side with respect to a direction crossing with the mounting direction, and wherein said process cartridge is mounted to the main assembly of the apparatus in a direction crossing with an axis of said photosensitive drum.

19. An electrophotographic image forming apparatus for forming an image on a recording material, to which a process cartridge is detachably mountable, said apparatus comprising:

(i) a main assembly drum driving force transmitting member;

(ii) a main assembly development driving force transmitting member;

(iii) a mounting portion for detachably mounting a process cartridge, said process cartridge including:

a first frame;

a second frame rotatably coupled with said first frame;

an electrophotographic photosensitive drum provided in said first frame;

a developing member, provided in said second frame, for developing an electrostatic latent image formed on said photosensitive drum with a developer;

a cleaning member, provided in said first frame, for removing the developer remaining on said photosensitive drum;

a removed developer feeding member, provided in said first frame, for transporting the developer removed by said cleaning member;

a drum driving force receiving member, provided in said first frame, for receiving, from the main assembly of the apparatus, a driving force for rotating said photosensitive drum when said process cartridge is mounted to the main assembly of the apparatus;

a development driving force receiving member, provided in said second frame, for receiving, from the main assembly of said apparatus, a driving force for rotating said developing member when said process cartridge is mounted to the main assembly of the apparatus; and a driving force transmitting member, provided in said second frame, for transmitting, to said removed developer feeding member, the driving force received from the main assembly of the apparatus by the development driving force receiving member to rotate said removed developer feeding member, wherein said development driving force receiving member is disposed downstream of said drum driving force receiving member with respect to a mounting direction of mounting said process cartridge to the main assembly of the apparatus, and wherein said development driving force receiving member and said drum driving force receiving member are provided in the same side with respect to a direction crossing with the mounting direction, and said process cartridge is mounted to the main assembly of the apparatus in the direction crossing with an axial direction of said photosensitive drum, wherein said drum driving force receiving member is in the form of a coupling, and said development driving force receiving member is in the form of a helical gear, and wherein said helical gear is disposed inside said coupling in the direction crossing with the mounting direction, and wherein said first frame and second frame are rotatably coupled by a shaft, and said helical gear is coaxial with the shaft.

20. An electrophotographic image forming apparatus according to claim 19, wherein a rotational center of said first frame and said second frame, a gear of said driving force transmitting member provided in said second frame, and a gear which is provided in said first frame and which is in meshing engagement with said gear of said driving force transmitting member are substantially on a line.

* * * * *

UNITED STATES PATENT AND TRADEMARK OFFICE

CERTIFICATE OF CORRECTION

PATENT NO. : 6,463,234 B2
DATED : October 8, 2002
INVENTOR(S) : Arimitsu et al

It is certified that error appears in the above-identified patent and that said Letters Patent is hereby corrected as shown below:

Title page,
Item [57], ABSTRACT,
Line 3, “rotatablely” should read -- rotatably --.

Column 1,
Line 24, “that” should read -- that is --.

Column 2,
Line 21, “increases” should read -- increase --.

Column 4,
Line 2, “cartridge” should read -- cartridge. --.

Column 6,
Line 9, “above.” should read -- above, --.
Line 24, “the.” should read -- the --.
Line 30, “6.” should read -- 6, --.

Column 7,
Line 32, “above described” should read -- above-described --.
Line 38, “gear the” should read -- the gear --.
Line 56, “a flanges” should read -- flanges --.
Line 63, “position” should read -- positioning --.

Column 8,
Line 52, “above described” should read -- above-described --.

Column 13,
Line 47, “d” should read -- a --.

Column 14,
Line 36, “above described” should read -- above-described --.

Column 15,
Line 50, “an” should read -- a --.

UNITED STATES PATENT AND TRADEMARK OFFICE

CERTIFICATE OF CORRECTION

PATENT NO. : 6,463,234 B2
DATED : October 8, 2002
INVENTOR(S) : Arimitsu et al

It is certified that error appears in the above-identified patent and that said Letters Patent is hereby corrected as shown below:

Column 16,
Line 4, “above described” should read -- above-described --.

Column 17,
Line 28, “he” should read -- be --.

Column 19,
Line 41, “member;” should read -- member, --.

Column 21,
Line 44, “member;” should read -- member, --.

Signed and Sealed this

Twenty-second Day of April, 2003

JAMES E. ROGAN
*Director of the United States Patent and Trademark Office*